US008428504B2

(12) United States Patent
Ando et al.

(10) Patent No.: US 8,428,504 B2
(45) Date of Patent: Apr. 23, 2013

(54) MEDIUM CLAMPING DEVICE AND IMAGE FORMING DEVICE

(75) Inventors: Chikara Ando, Ebina (JP); Toshinori Sasaki, Ebina (JP); Masaru Funayanagi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 288 days.

(21) Appl. No.: 12/851,914

(22) Filed: Aug. 6, 2010

(65) Prior Publication Data

US 2011/0142514 A1 Jun. 16, 2011

(30) Foreign Application Priority Data

Dec. 10, 2009 (JP) ..... 2009-280535

(51) Int. Cl.
*G03G 15/00* (2006.01)
*B65H 9/00* (2006.01)

(52) U.S. Cl.
USPC ..... 399/361; 399/388; 271/240

(58) Field of Classification Search ..... 399/361, 399/388, 400, 406; 271/169, 226, 236, 238, 271/240; 492/22, 25
See application file for complete search history.

(56) References Cited

U.S. PATENT DOCUMENTS 6,082,731 A * 7/2000 Yamazaki ..... 271/240

FOREIGN PATENT DOCUMENTS

JP 58033279 A * 2/1983
JP 01303249 A * 12/1989
JP 10218459 A * 8/1998
JP A-2008-254887 10/2008

* cited by examiner

*Primary Examiner* — Judy Nguyen
*Assistant Examiner* — Justin Olamit
(74) *Attorney, Agent, or Firm* — Oliff & Berridge, PLC

(57) ABSTRACT

A medium clamping device includes: a first circularly-moving body having a circumferential surface harder than a recording medium, a longer length in a direction orthogonal to a circularly-moving direction than the recording medium in a first direction; a second circularly-moving body where the recording medium passes between the surfaces of the two circularly-moving bodies in a second direction crossing the first direction; a load applying section applying a load to at least one of the two circularly-moving bodies to clamp the recording medium; a belt member surrounding the surface of at least one of the two circularly-moving bodies, at a place outside an area touching the recording medium when the recording medium passes; and a belt-member-protecting member which is aligned with the belt member in a recording-medium-passing direction, includes a portion closer to a recording-medium-passing path than the belt member to protect the belt member from contacting the recording medium.

19 Claims, 20 Drawing Sheets

MEDIUM CLAMPING DEVICE AND IMAGE FORMING DEVICE

CROSS-REFERENCE TO RELATED APPLICATION

This application is based on and claims priority under 35 USC 119 from Japanese Patent Application No. 2009-280535, filed Dec. 10, 2009.

BACKGROUND (i) Technical Field

The present invention relates to a medium clamping device and an image forming device.

(ii) Related Art

There is a medium clamping device provided in an image forming device.

SUMMARY

According to an aspect of the invention, a medium clamping device includes:

a first circularly moving body that has a circumferential surface moving circularly and harder than a recording medium with a surface where an image is formed, and that has a longer length in a direction orthogonal to a circularly moving direction of the circumferential surface than a length in a first direction of the surface of the recording medium;

a second circularly moving body that has a circumferential surface moving circularly and harder than the recording medium, and that has a longer length in a direction orthogonal to a circularly moving direction of the circumferential surface of the second rotating body than the length in the first direction of the surface of the recording medium, where the recording medium passes between the circumferential surface of the first circularly moving body and the circumferential surface of the second circularly moving body in a second direction crossing the first direction;

a load applying section that clamps, by applying a load to at least one of the first circularly moving body and the second circularly moving body, the recording medium by the load by using the first circularly moving body and the second circularly moving body;

a belt member that surrounds the circumferential surface of at least one of the first circularly moving body and the second circularly moving body, at a place outside an area touching the recording medium when the recording medium passes, and that is softer than the circumferential surface and is thinner than the recording medium; and a belt member protecting member that is aligned with the belt member in a direction of passing for the recording medium, that includes a portion closer to a path of passing for the recording medium than the belt member, and that protects the belt member from contacting the recording medium.

BRIEF DESCRIPTION OF THE DRAWINGS

Exemplary embodiments of the present invention will be described in detail based on the following figures, wherein:

FIG. 16 illustrates a state in which the deburring driving motor and the gear are attached to the support section illustrated in FIG. 15;

DETAILED DESCRIPTION

Exemplary embodiments of the invention will be described below with reference to the drawings.

[Image Forming Device]

Figure 1:
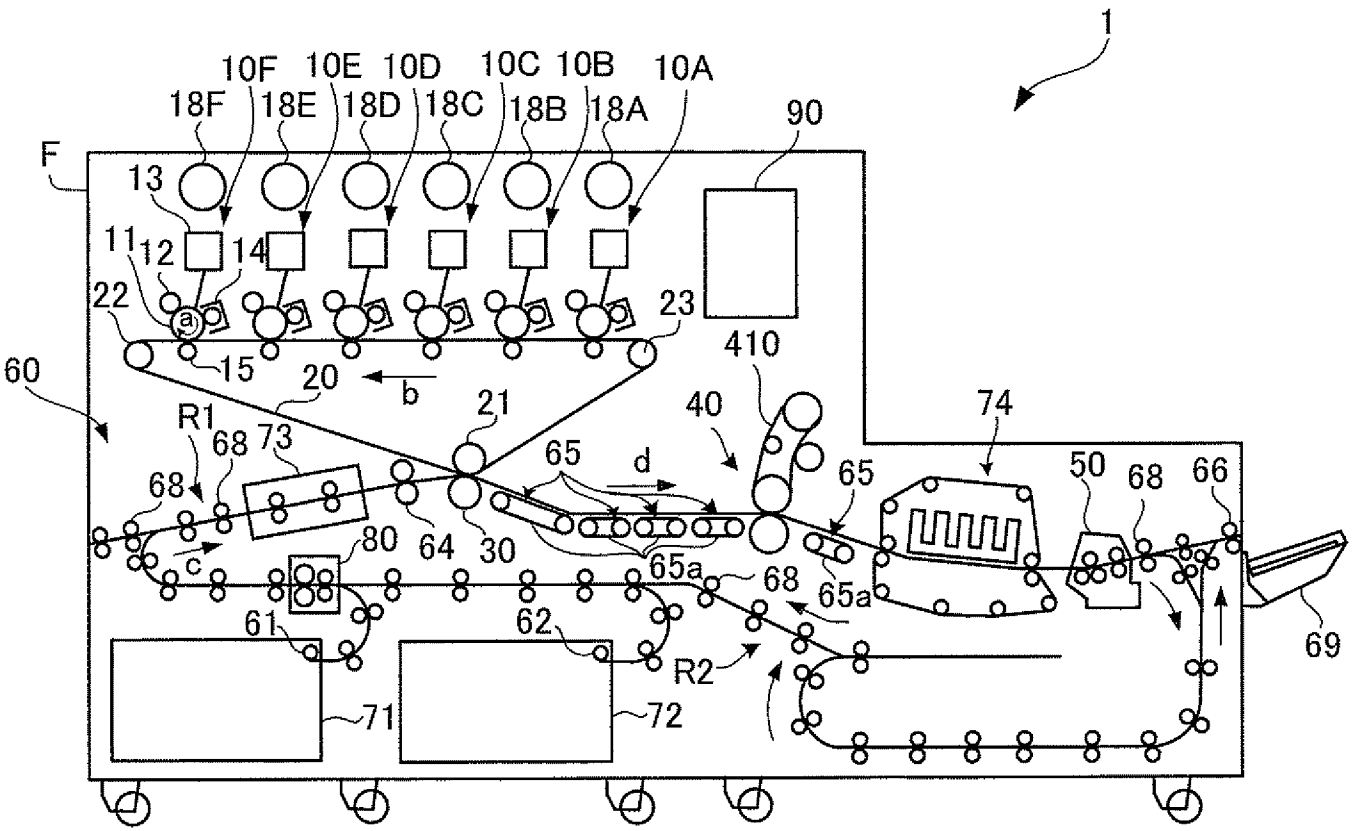
FIG. 1 is a schematic structural diagram that illustrates an embodiment of the image forming device according to the present invention.

FIG. 1 is a schematic structural diagram that illustrates an embodiment of the image forming device according to the present invention.

An image forming device 1 illustrated in FIG. 1 forms a toner image by forming an electrostatic latent image with a toner and developing the electrostatic latent image, and then transfers and fixes the toner image to a paper sheet, thereby finally forming an image of the fixed toner image on the paper sheet. Incidentally, this image forming device 1 accepts not only a paper sheet—i.e. a paper recording medium, but a resinous recording medium represented by an OHP sheet.

However, the following description will be provided by using the paper recording medium as a representative example unless otherwise specified. The image forming device 1 is a tandem type of color printer in which six image forming sections 10A, 10B, 10C, 10D, 10E and 10F that respectively form images of mutually different colors are disposed in parallel. The image forming device 1 is capable of printing a single-colored image in a single-color mode and a color image formed by toner images of plural colors in a full-color mode. For example, among the six image forming sections 10A through 10F, the four image forming sections 10C, 10D, 10E and 10F correspond to yellow (Y), magenta (M), cyan (C) and black (K), respectively, and the remaining two image forming sections 10A and 10B correspond to spot colors except these YMCK colors. The spot colors include, for example, colors that are not easy to precisely express by the combination of YMCK, such as a color that represents a corporate color of a particular company, pastel colors, and transparent colors for luster. The image forming device 1 includes six toner cartridges 18A, 18B, 18C, 18D, 18E and 18F that contain toners of the colors corresponding to the image forming sections 10A through 10F, respectively.

Since the six image forming sections 10A through 10F have similar structures, the image forming section 10F corresponding to black will be described as representing these six image forming sections. The image forming section 10F includes a photoreceptor 11, a charging device 12 that charges the surface of the photoreceptor 11, an exposure device 13 that irradiates the photoreceptor 11 with exposure light based on an image signal supplied externally, a developing device 14 that develops the surface of the photoreceptor 11 with a toner, and a primary transfer device 15 that transfers the toner image to an intermediate transfer belt 20. The photoreceptor 11 has a surface in the shape of a cylinder and rotates in the direction of an arrow "a" around an axis of the cylinder.

Further, the image forming device 1 includes the intermediate transfer belt 20 to which the toner image is transferred from the photoreceptor 11 of each of the image forming sections 10A through 10F, a secondary transfer device 30 that transfers the toner image from the intermediate transfer belt 20 to a paper sheet, a fixing device 40 that fixes the toner on the paper sheet, a decurler 50 that corrects a curl of the paper sheet, and a paper conveyance section 60 that conveys the paper sheet along a conveyance course 1 and a front-and-back inversion course R2. Furthermore, the image forming device 1 includes paper containers 71 and 72 that contain the paper sheet (s), a deburring device 80 that removes a burr of the paper sheet before image formation, a posture correcting section 73 that corrects the posture of the paper sheet. The image forming device 1 further includes a cooling device 74 that cools the paper sheet after the toner image is fixed, an output paper container 69 that receives the paper sheet after the image formation by the image forming device 1 is completed, and a controller 90 that controls each section of the image forming device 1.

The intermediate transfer belt 20 is a belt-shaped endless member supported by belt support rolls 21, 22 and 23, and circulates in the direction of an arrow "b" that passes by the image forming sections 10A through 10F and the secondary transfer device 30 in this order. Here, the combination of the image forming sections 10A through 10F, the intermediate transfer belt 20, the secondary transfer device 30 and the fixing device 40 is an example of the image forming section according to the present invention.

The paper conveyance section 60 conveys the paper sheet along the conveyance course R1 and the front-and-back inversion course R2. The paper conveyance section 60 includes drawing rolls 61 and 62 that draw paper sheets from the paper containers 71 and 72, respectively, a registration roll 64 that sends each of the paper sheets to the secondary transfer device 30 in timing for the transfer of the toner image by the secondary transfer device 30, belt conveyance devices 65 that convey the paper sheet from the secondary transfer device 30 to the fixing device 40 while making the paper sheet cling to the outer surfaces of the belt conveyance devices 65, an output roll 66 that outputs the paper sheet to the outside of the image forming device 1, and conveyance rolls 68 that are respectively disposed along the conveyance course R1 and the front-and-back inversion course R2 and convey the paper sheets. Incidentally, in FIG. 1, only a part of the conveyance rolls 68 in the image forming device 1 is indicated by a reference character for easy viewing.

The paper conveyance section 60 conveys the paper sheet from each of the paper containers 71 and 72 along the conveyance course R1 passing through the deburring device 80, the posture correcting section 73, the secondary transfer device 30, the fixing device 40, the cooling device 74 and the decurler 50 sequentially. When double-sided printing is executed in the image forming device 1, the paper conveyance section 60 conveys the paper sheet along the front-and-back inversion course R2 diverging from the conveyance course R1 and returning to the conveyance course R1. Subsequently, the paper sheet is turned back and then turned upside down in the front-and-back inversion course R2. The paper sheet after being turned upside down returns to the conveyance course R1, subsequently passes through the deburring device 80 and the posture correcting section 73 again, and the toner image is transferred by the secondary transfer device 30 to the reverse side of the paper sheet, namely the side to which the toner image is yet to be transferred.

A basic operation of the image forming device 1 illustrated in FIG. 1 will be described. The description will be provided by taking the image forming section 10F corresponding to black (K) as a representative example. The photoreceptor 11 is driven to rotate in the direction of the arrow "a", and a charge is applied to the surface of the photoreceptor 11 by the charging device 12. The exposure device 13 forms an electrostatic latent image on the surface of the photoreceptor 11 by irradiating the photoreceptor 11 with exposure light based on an image signal supplied externally. To be more specific, the exposure device 13 forms the electrostatic latent image on the surface of the photoreceptor 11 by emitting the exposure light based on data corresponding to black in the image signal. The developing device 14 forms a toner image by developing the electrostatic latent image with a black toner. The developing device 14 of the image forming section 10F is supplied with the toner by the toner cartridge 18F. The photoreceptor 11 retains the toner image upon formation of the toner image. The toner image formed on the surface of the photoreceptor 11 is transferred to the intermediate transfer belt 20 by the primary transfer device 15.

The five image forming sections 10A through 10E corresponding to the colors except black also respectively form toner images corresponding to the respective colors in a manner similar to the image forming section 10F corresponding to black. The intermediate transfer belt 20 is supported by the belt support rolls 21 through 23 and circulates in the direction of the arrow "b". The image forming sections 10A through 10F transfer the toner images of the respective colors to the intermediate transfer belt 20 where the toner images are superimposed. In this way, the toner images according to the image data are formed on the intermediate transfer belt 20, and the intermediate transfer belt 20 moves while retaining the toner images.

Meanwhile, the paper sheets in the paper containers 71 and 72 are taken out by the drawing rolls 61 and 62, and then conveyed along the conveyance course R1 in the direction of an arrow "c" by the conveyance roll 68 and the registration roll 64 toward the secondary transfer device 300. The burr removing device 80 disposed in the conveyance course R1 removes a burr present at an edge of the paper sheet, and the posture and the position of the paper sheet are corrected by the posture correcting section 73. The secondary transfer device 30 transfers the toner images on the intermediate transfer belt 20 to the paper sheet, by applying a bias potential for transfer between the intermediate transfer belt 20 and the paper sheet. The toner images are finally transferred to the paper sheet by the secondary transfer device 30 in this way. The paper sheet is then further conveyed in the direction of an arrow "d" by the belt conveyance devices 65, and the toner images transferred to the surface of the paper sheet are fixed by the fixing device 40. In this way, the image is formed on the paper sheet. The fixing device 40 has a fixing belt 410 to raise thermal capacity. The paper sheet with the surface where the image is formed is cooled by the cooling device 74, and then a curl of the paper sheet is corrected by the decurler 50. Subsequently, the paper sheet is output by the output roll 66.

When a double-sided printing mode is performed in the image forming device 1, the paper conveyance section 60 conveys, along the front-and-back inversion course R2, a paper sheet after being conveyed along the conveyance course R1. Along the front-and-back inversion course R2, the paper conveyance section 60 turns the paper sheet upside down and then conveys the paper sheet along the conveyance course R1 again. Meanwhile, when output of a paper sheet after being turned upside down is designated, although this is not the double-sided printing, the paper conveyance section 60 temporarily retracts, up to a midpoint of the front-and-back inversion course R2, the paper sheet after being conveyed along the conveyance course R1. Subsequently, the paper conveyance section 60 conveys the paper sheet in the reverse direction and then outputs the paper sheet. The output paper sheet is then laid in the output paper container 69.

[Deburring Device]

Figure 2:
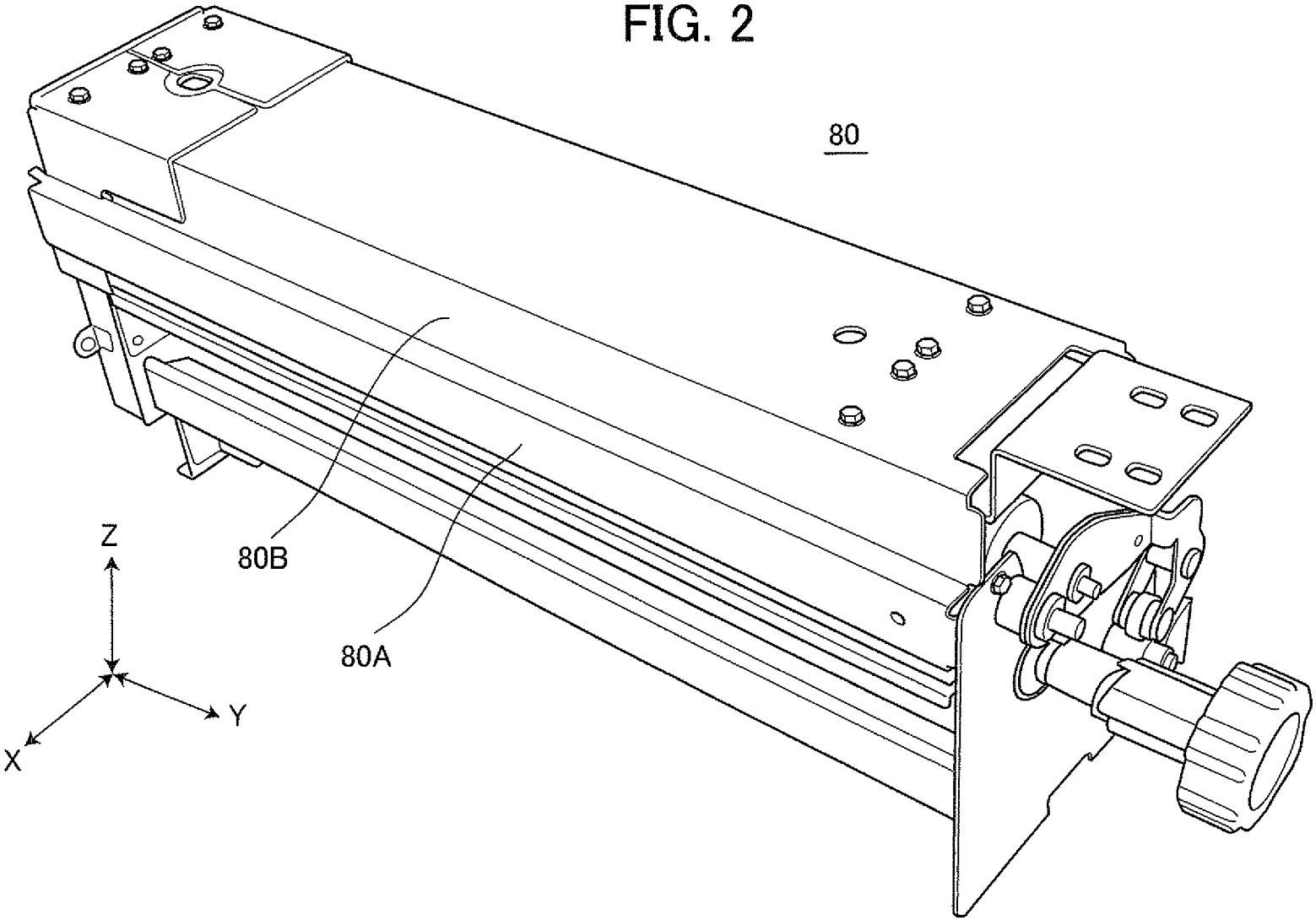
FIG. 2 is a perspective diagram of the deburring device that is an exemplary embodiment of the medium clamping device according to the present invention.

FIG. 2 is a perspective diagram of the deburring device that is an exemplary embodiment of the medium clamping device according to the present invention.

The deburring device 80 illustrated in FIG. 2 is disposed below the image forming sections 10A, 10B, 10C, 10D, 10E and 10F and the secondary transfer device 30 in the image forming device 1 illustrated in FIG. 1. The deburring device 80 is attached to a support frame F (see FIG. 1) that supports the entire structure of the image forming device 1. The deburring device 80 includes a device main unit 80A and a support section 80B that supports the device main unit 80A. The deburring device 80 further includes a motor unit 800 (see FIG. 16) that will be described later.

The support section 80B is attached to the support frame F of the image forming device 1 and supports the device main unit 80A while allowing the device main unit 80A to be removable from the image forming device 1. A direction in which the device main unit 80A conveys a paper sheet is referred to as a conveyance direction X (or, a passing direction X). Further, a direction that extends along the width of the conveyed paper sheet and crosses the conveyance direction X is referred to as a widthwise direction Y. Furthermore, a direction that crosses the conveyance direction X and the widthwise direction Y is referred to as a vertical direction Z.

Figure 3:
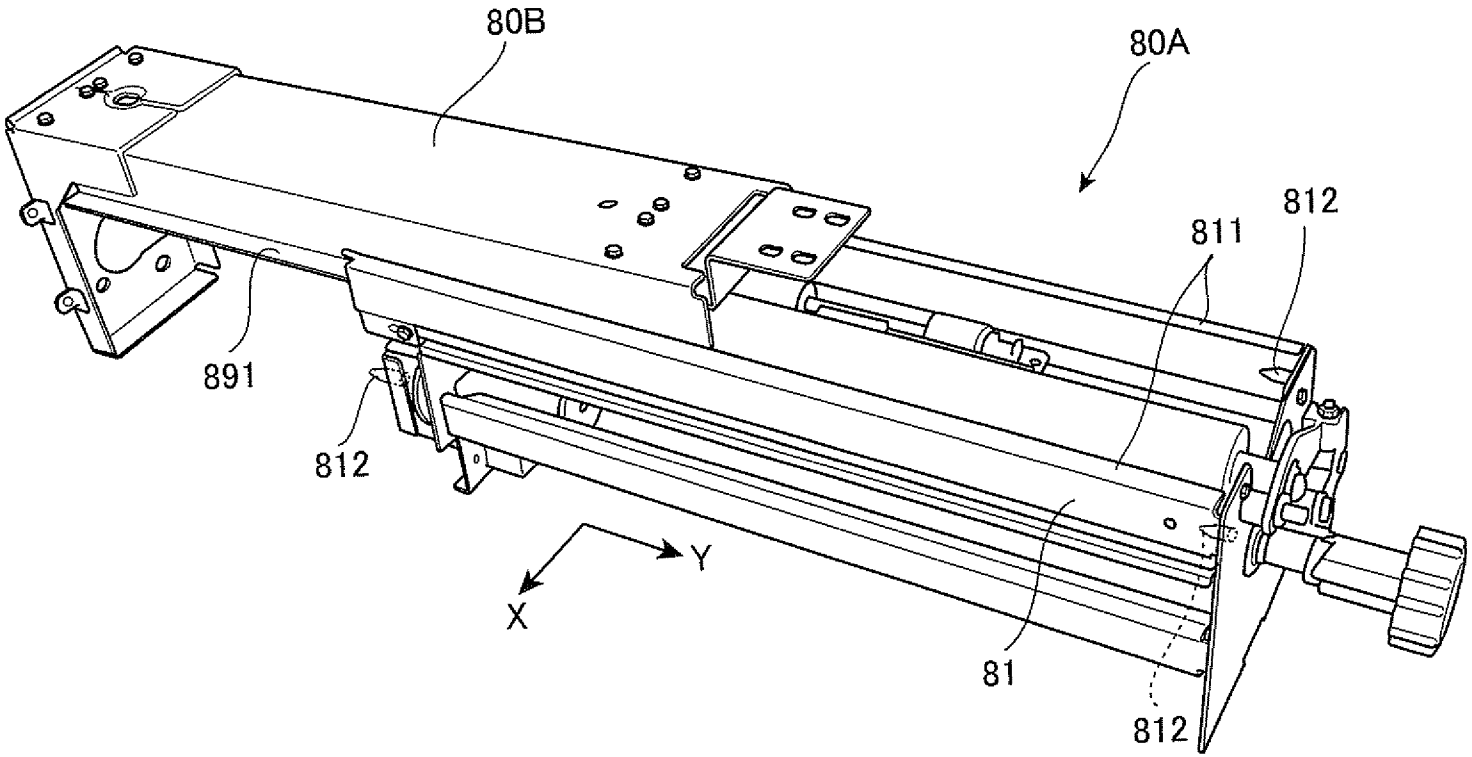
FIG. 3 is a perspective diagram that illustrates a state in which the device main unit of the deburring device illustrated in FIG. 2 is being drawn from the support section.

FIG. 3 is a perspective diagram that illustrates a state in which the device main unit of the deburring device illustrated in FIG. 2 is being drawn from the support section.

The support section 80B is provided with rails 891 extending in the widthwise direction Y, and rails 811 extending in parallel with the rails 891 in the widthwise direction Y are provided at an upper part of the device main unit 80A. The rails 891 of the support section 80B are formed by bending both edges of the support section 80B outwardly along the conveyance direction X. Hence, there are two rails 891 provided at both sides of the support section 80B aligned along the conveyance direction X. The rails 811 of the device main unit 80A are formed by bending inwardly upper parts at both sides of a frame 81, which supports the entire structure of the device main unit 80A, namely, by bending these upper parts in the direction of facing each other. The rails 811 of the device main unit 80A are provided to correspond to the rails 891 of the support section 80B. The rails 811 of the device main unit 80A are on the rails 891 of the support section 80B. The rails 811 of the device main unit 80A move while sliding on the rails 891, so that the device main unit 80A moves in the widthwise direction Y along which the rails 891 extend. When, for example, removing a paper sheet jamming inside, an operator pulls the device main unit 80A in the widthwise direction Y so that the device main unit 80A is removed from the image forming device 1. Further, the device main unit 80A is attached to the image forming device 1 by being pushed in along the widthwise direction Y. The frame 81 that supports the structure of the device main unit BOA is provided with projections 812 that position the device main unit 80A relative to the support section 80B when the device main unit 80A is attached.

The support section 80B supports the device main unit 80A via a buffering mechanism incorporated therein, but the structure of the support section 802 will be described later and the device main body 80A will be described first.

[Device Main Unit]

Figure 4:
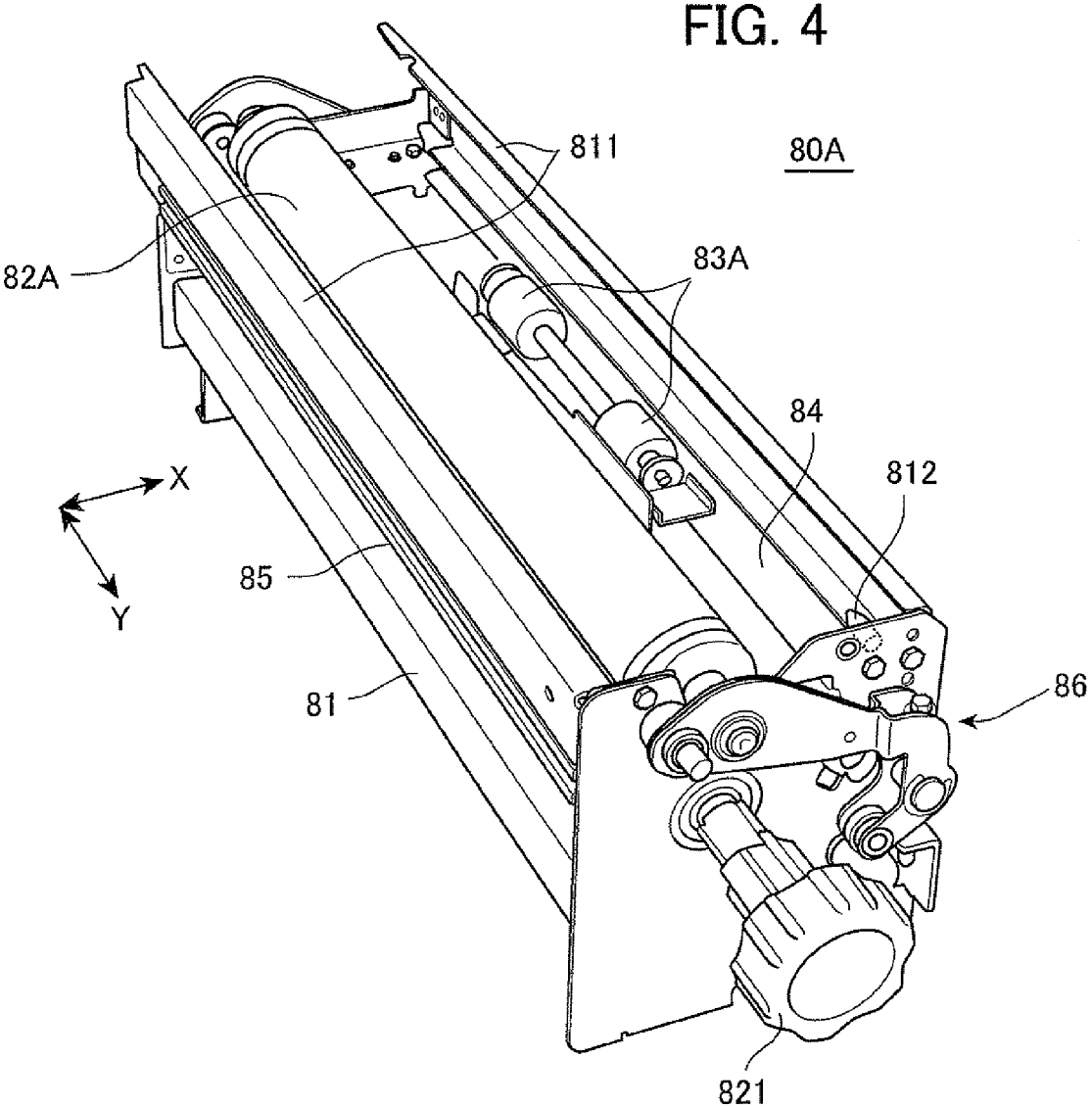
FIG. 4 is a perspective view of the device main unit illustrated in FIG. 3.
Figure 5:
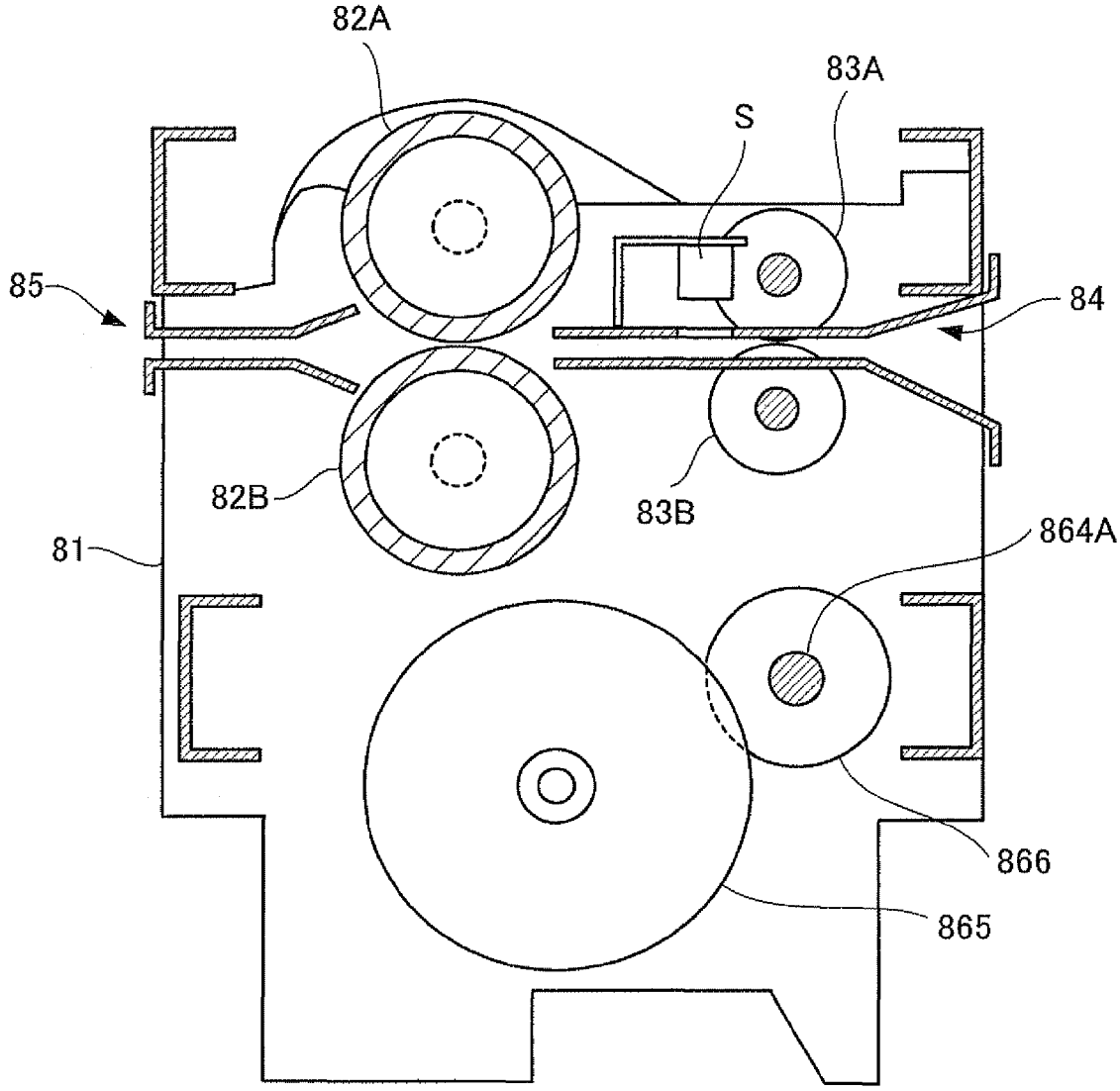
FIG. 5 is a sectional view that illustrates a schematic structure of the inside of the device main unit illustrated in FIG. 4.

FIG. 4 is a perspective view of the device main unit illustrated in FIG. 3. FIG. 5 is a sectional view that illustrates a schematic structure of the inside of the device main unit illustrated in FIG. 4.

The device main unit 80A illustrated in FIG. 4 and FIG. 5 includes a pair of deburring rolls 82A and 82B, a pair of auxiliary conveyance rolls 83A and a pair of auxiliary conveyance rolls 83B, paper guide sections 84 and 85 that guide a paper sheet, a roll support system 86 that supports the deburring roll 82A that is one of the pair of deburring rolls 82A and 82B, and the frame 81 that supports the structure of each part of the device main unit 80A. Further, the device main unit 80A includes a paper sensor S that detects the passage of a paper sheet. First, the device main unit 80A allows the supplied paper sheet to pass between the auxiliary conveyance rolls 83A and 83B, while causing the paper guide section 84 to guide the supplied paper sheet. Subsequently, the device main unit BOA allows the paper sheet to pass between the deburring rolls 82A and 82B and then causes the paper guide section 85 to guide the paper sheet which is then output.

The pair of deburring rolls 82A and 82B are disposed at positions to vertically sandwich the paper sheet and to face each other. The deburring rolls 82A and 82B function as a first circularly moving body (in other words, a first cylindrical body) and a second circularly moving body (in other words, a second cylindrical body), respectively, each having a circumferential surface that moves circularly. Of the deburring rolls 82A and 82B, the (lower) deburring roll 82B disposed at a lower position is a drive roll that is driven to rotate by a deburring driving motor 801 (see FIG. 16). The (upper) deburring roll 82A is disposed at an upper position and serves as a following roll. When the upper deburring roll 82A is in contact with the lower deburring roll 82B, the upper deburring roll 82A and the lower deburring roll 82B are driven to rotate in the same direction at the positions where the paper sheet is held in between. Incidentally, FIG. 4 illustrates a grip 821 that enables the operator to rotate the lower deburring roll 82B manually so that a paper sheet is removed when a paper jam occurs.

The pair of auxiliary conveyance rolls 83A and the pair of auxiliary conveyance rolls 83B are members that rotate while holding the paper sheet in between thereby conveying the paper sheet. Even in a state in which the deburring rolls 82A and 82B are away from each other, which will be described later, the paper sheet is conveyed by the auxiliary conveyance rolls 83A and 83B. Of the pair of auxiliary conveyance rolls 83A and the pair of auxiliary conveyance rolls 83B, the (lower) auxiliary conveyance rolls 83B disposed at a lower position are drive rolls, whereas the (upper) auxiliary conveyance rolls 83A disposed to face the lower auxiliary conveyance roll 83B are following rolls. The lower auxiliary conveyance rolls 83B are driven by the deburring driving motor 801 (see FIG. 16) through a gear (not illustrated) linked to the lower deburring roll 82B.

The upper deburring roll 82A is given a load directed to the lower deburring roll 82B, so that when the paper sheet is clamped between the upper deburring roll 82A and the lower deburring roll 82B, the height of a burr present at an edge of the paper sheet is reduced.

Figure 6:
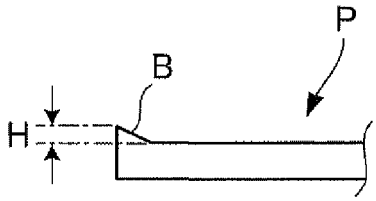
FIG. 6 is an enlarged sectional view of the edge of the paper sheet.

FIG. 6 is an enlarged sectional view of the edge of the paper sheet.

When a paper sheet P is cut out of a material sheet, a burr B swelling due to the cutting is formed at the edge of the paper sheet P. The burr B is usually formed at the edge of each of four sides of the paper sheet. When the paper sheet having the burr is supplied to the secondary transfer device 30 and the fixing device 40, the burr hits the intermediate transfer belt 20 and/or the fixing belt 410 of the fixing device 40, causing scratches that lead to an image defect. When the paper sheet is clamped between the upper deburring roll 82A and the lower deburring roll 82B, the burr B of the paper sheet is pressed and a burr height H is reduced. Further, the crest of the burr B is deformed and smoothed. The paper sheet after passing between the upper deburring roll 82A and the lower deburring roll 82B in the deburring device 80 is supplied to the secondary transfer device 30 and the fixing device 40 and the image is formed. Since the paper sheet after the burr B is smoothed and the burr height H is reduced is applied to the secondary transfer device 30 and the fixing device 40 disposed downstream from the deburring device 80, occurrences of scratches and image defects due to the scratches are reduced.

[Roll Support System]

Next, a system of supporting the deburring rolls 82A and 82B will be described.

Figure 7:
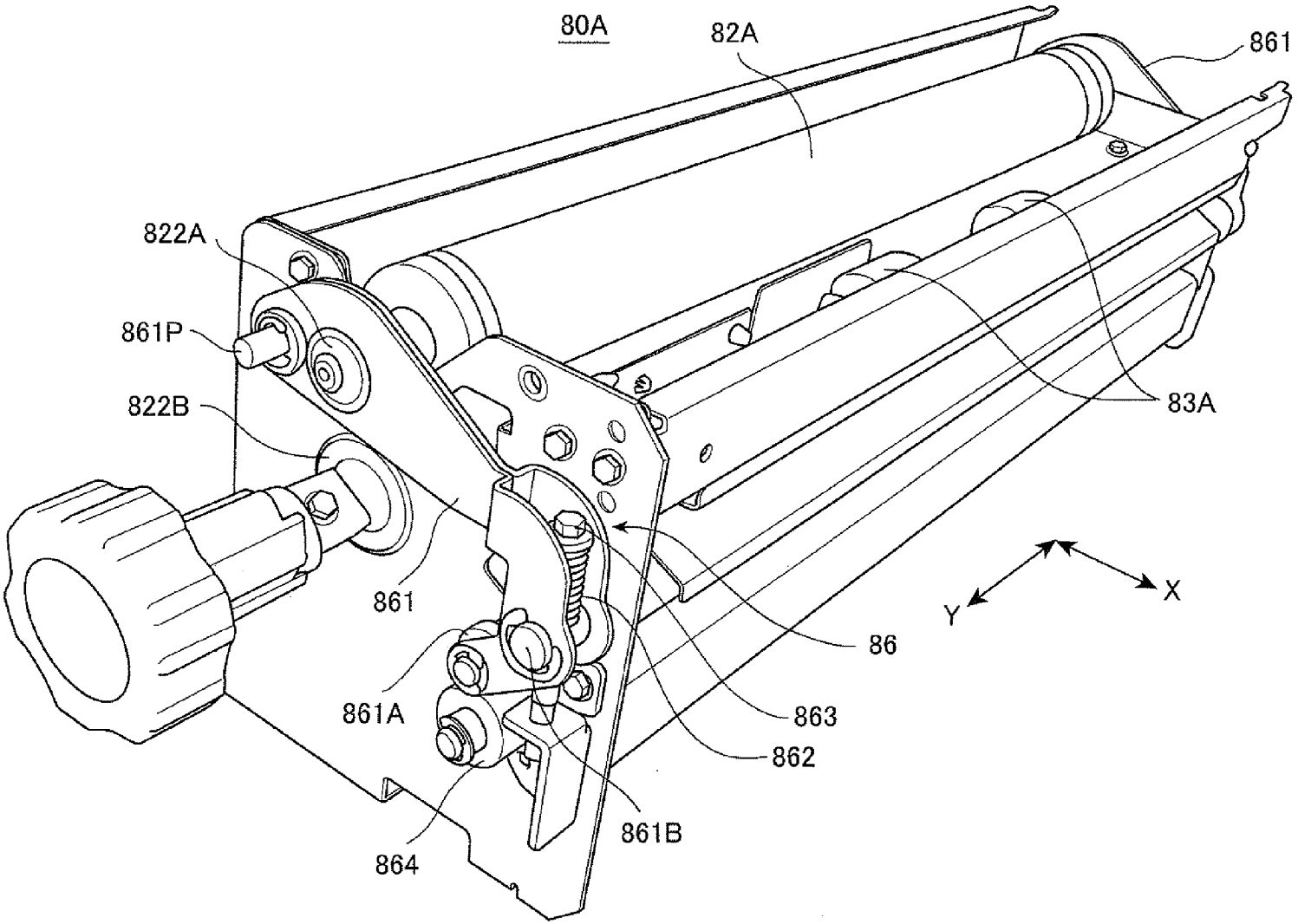
FIG. 7 is a perspective view of the device main unit illustrated in FIG. 4, when viewed from another angle.
Figure 8:
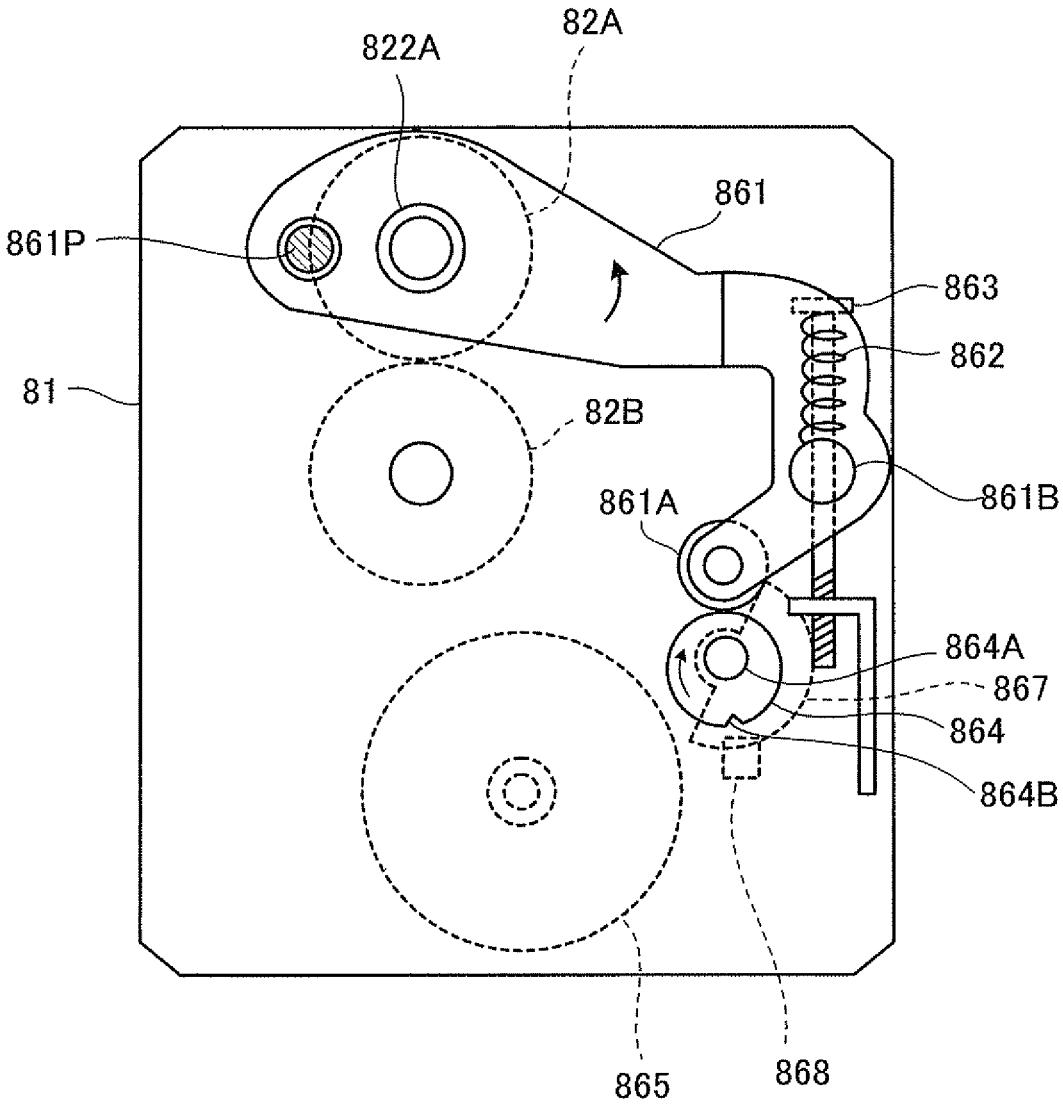
FIG. 8 is a diagram for describing the structure of the roll support system.

FIG. 7 is a perspective view of the device main unit illustrated in FIG. 4, when viewed from another angle. Further, FIG. 8 is a diagram for describing the structure of the roll support system.

There is a bearing 822B that is fixed to the frame 81 and supports a rotation shaft of the lower deburring roll 82B. The upper deburring roll 82A is given by the roll support system 86 a load directed to the lower deburring roll 82B. The roll support system 86 includes a roll support arm 861 that supports a rotation shaft of the upper deburring roll 82A, a spring member 862 that presses the roll support arm 861, a bolt 863 that holds down the spring member 862, a cam 864 that causes the roll support arm 861 to move up and down, and a retracting motor 865 (see FIG. 8) that drives and thereby rotates the cam 864. The roll support arm 861, the spring member 862, the bolt 863 and the cam 864 are each provided as a pair disposed on both sides of the device main unit 80A and aligned in the widthwise direction Y. The roll support arm 861 supports the upper deburring roll 82A at both sides.

The roll support arm 861 is supported by a rotation shaft 861P fixed to the frame 81, and is rotatable relative to the frame 81 about the rotation shaft 861P. There is a bearing 822A that supports a rotation shaft of the upper deburring roll 82A and is fixed to the roll support arm 861. In other words, the upper deburring roll 82A is supported by the roll support arm 861.

[Load Applying Section]

The spring member 862 is interposed between the head of the bolt 863 attached to the frame 81 and a pin 861B provided at the roll support arm 861. The spring member 862 is a compression spring, which is pressed down by the bolt 863 from above and thereby presses the roll support arm 861 downward via the pin 861B. With this pressing-down force, the upper deburring roll 82A supported by the roll support arm 861 is given the load directed to the lower deburring roll 82B.

In the roll support arm 861, the distance between the pin 861B receiving the load of the spring member 862 and the rotation shaft 861P is longer than the distance between the upper deburring roll 82A and the rotation shaft 861P. To be more specific, the distance between the rotation shaft 861P and the pin 861B is about five times the distance between the rotation shaft 861P and the upper deburring roll 82A. For this reason, the upper deburring roll 82A is given a heavy load by the leverage as compared with the load applied by the spring member 862 to press the roll support arm 861. The size of the load is regulated based on the fastening by the bolt 863, and a load of 55 kgw is applied between the upper deburring roll 82A and the lower deburring roll 82B. At this moment, the spring member 862 gives the pin 861B a lighter load corresponding to the distance from the rotation shaft 861P than the load applied to the upper deburring roll 82A. Specifically, about one-fifth of the load applied to the upper deburring roll 82A is given to the pin 861B. In this way, the roll support arm 861, the spring member 862, the bolt 863 and the pin 861B function as a load applying section, where the paper sheet is clamped between the upper deburring roll 82A and the lower deburring roll 82B by using the load applied to the upper deburring roll 82A. Incidentally, as the load applying section, there may be adopted a structure in which the lower deburring roll 82B in stead of the upper deburring roll 82A is given a load or a structure in which both of these rolls are given a load. Alternatively, as the load applying section, there may be adopted a structure in which a load is directly applied to the shaft of the roll by using a spring member or the like without using the roll support arm although the size of the spring member is increased.

[Retraction Movement]

FIG. 8 is a diagram that illustrates a clamping state in which the paper sheet is clamped between the upper deburring roll 82A and the lower deburring roll 82B. When the cam 864 is rotated starting from this clamping state, the upper deburring roll 82A retracts from and is thereby away from the lower deburring roll 82B. Subsequently, a mechanism to shift the state will be described.

A cam follower 861A is provided at an end of the roll support arm 861 opposite to the end where the rotation shaft 861P is provided, and the cam 864 is in contact with the roll support arm 861 via the cam follower 861A. The cam 864 is an eccentric cam and has a notch 864B at the furthest position in a cam surface from a rotation shaft 864A. The cam 864 is driven to rotate by the retracting motor 865 controlled by the controller 90 (see FIG. 1). To be more specific, the retracting motor 865 drives the cam 864 by driving a gear 866 (see FIG. 5) that shares the rotation shaft 864A with the cam 864. Also, a blade member 867 having a semicircle shape and corresponding to the displacement of the cam 864 is attached to the rotation shaft 864A of the cam 864. The blade member 867 represents the rotating posture of the cam 864 by rotating while interlocking with the cam 864. A sensor 868 detects the passage of the blade member 867 and transmits a signal representing a detection result to the controller 90 (see FIG. 1). The controller 90 causes the cam 864 to rotate based on the signal sent from the sensor 868, thereby enabling the cam 864 to take a predetermined posture.

Figure 9:
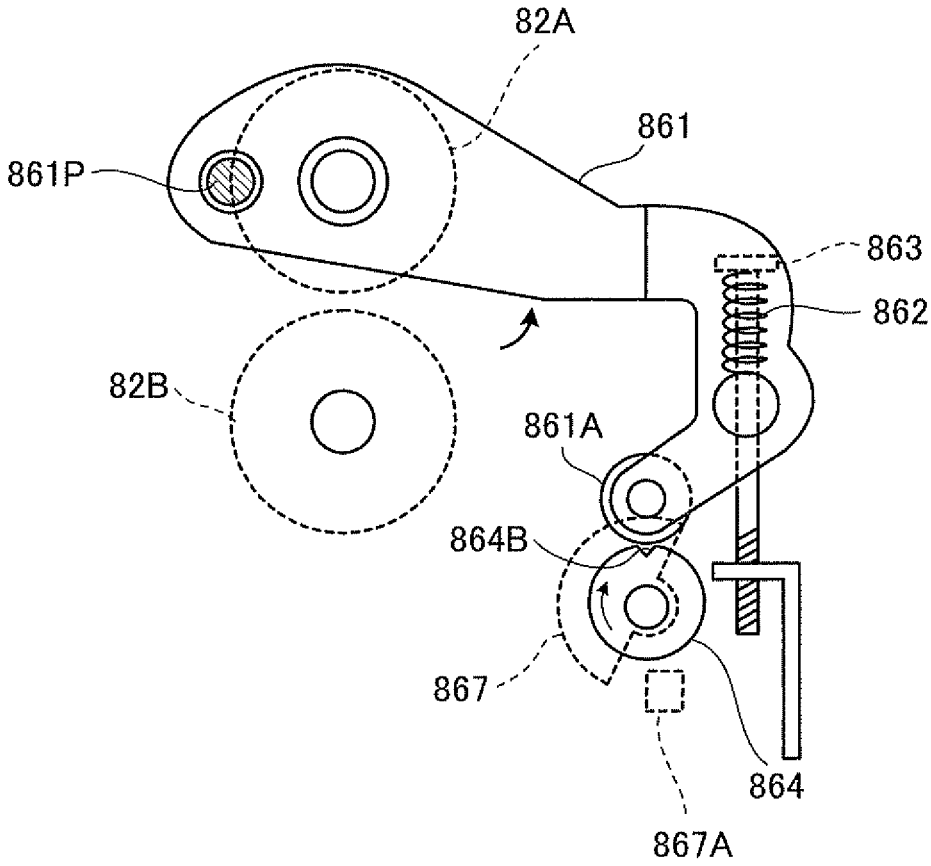
FIG. 9 is a diagram for describing the retraction movement of the roll.

FIG. 9 is a diagram for describing the retraction movement of the roll.

When the retracting motor 865 drives and thereby rotates the cam 864, the cam 864 pushes up the roll support arm 861 by resisting the pressing-down load applied by the spring member 862. The blade member 867 rotates while interlocking with the cam 864. After the passage of the blade member 867 is detected by the sensor 868, the controller 90 causes the retracting motor 865 to stop rotating the cam 864. As a result, the cam 864 is rotated a half turn and thereby contacts the cam follower 861A at the furthest position from the center of rotation as illustrated in FIG. 9. When the cam follower 861A is engaged in the notch 864B formed at the furthest position from the center of rotation of the cam 864, the cam 864 is in a stable state at this furthest position. In this way, the retracting motor 865, the cam 864 and the roll support arm 861 function as a switching section that switches between a separated state in which the upper deburring roll 82A and the lower deburring roll 82B are separated from each other and the clamping state in which the upper deburring roll 82A and the lower deburring roll 82B clamp the recording medium. By the rotation of the cam 864, the roll support arm 861 is rotated upward about the rotation shaft 861P while being pushed up, and the upper deburring roll 82A is retracted from the lower deburring roll 82B. In the separated state, the upper deburring roll 82A and the lower deburring roll 82B are away from each other, preventing the paper sheet from being clamped. In the separated state, the space between the upper deburring roll 82A and the lower deburring roll 82B is sufficiently larger than the maximum thickness of the paper sheet processable by the image forming device 1 and thus, the paper sheet is not conveyed. At this moment, the paper sheet is conveyed by the auxiliary conveyance rolls 83A and 83B and passes between the upper deburring roll 82A and the lower deburring roll 82B.

When the retracting motor 865 further rotates the cam 864 a half turn based on the controller 90 upon shifting from the separated state illustrated in FIG. 9, the cam 864 contacts the cam follower 861A at the nearest position from the center of rotation. As a result, the upper deburring roll 82A and the lower deburring roll 82B enter the clamping state where the paper sheet is clamped in between (see FIG. 8). Incidentally, in the clamping state illustrated in FIG. 8, the cam 864 and the cam follower 861A may be separated from each other.

The shift between the clamping state illustrated in FIG. 8 and the separated state illustrated in FIG. 9 is controlled by the controller 90 (see FIG. 1). The controller 90 controls the movement of the retracting motor 865 by running a program stored in a memory (not illustrated) with a processor. The controller 90 acquires the type of the recording medium based on input operation of the operator or data supplied from the outside of the image forming device 1, and also obtains a processing state of the recording medium in each element of the image forming device 1, thereby determining either the clamping state or the separated state. In this way, the state of the upper deburring roll 82A and the lower deburring roll 823 is switched depending on the type of the recording medium passing between the upper deburring roll 82A and the lower deburring roll 823. Incidentally, the controller 90 controls the entire image forming device 1, but the controller 90 may be provided independently as a controller dedicated to the deburring device 80.

In the deburring device 80 of the present exemplary embodiment, the recording medium is a paper-sheet medium, and when the recording medium has a basis weight higher than a predetermined basis weight, the upper deburring roll 82A and the lower deburring roll 82B are in the separated state. To be more specific, when the basis weight is equal to or higher than 157 gsm, the upper deburring roll 82A and the lower deburring roll 82B are in the clamping state, whereas when the basis weight is lower than 157 gsm, the upper deburring roll 82A and the lower deburring roll 82B are in the separated state. Here, the basis weight of 157 gsm is equivalent to the thickness of about 150 μm of a general paper sheet. When the paper sheet whose basis weight is less than 157 gsm is clamped by the upper deburring roll 82A and the lower deburring roll 823, a wrinkle may be formed. On the other hand, the paper sheet having a basis weight of less than 157 gsm is softer than the paper sheet having a basis weight equal to or more than 157 gsm and therefore is unlikely to mar the members disposed downstream from the deburring device 80 such as the intermediate transfer belt 20 and the fixing belt 410 (see FIG. 1). Accordingly, for the paper sheet whose basis weight is less than 157 gsm, the upper deburring roll 82A and the lower deburring roll 82B are in the separated state and the clamping is not carried out.

Further, when a passing recording medium is made of paper and has a width less than 320 mm in the widthwise direction Y (FIG. 2) or when the recording medium is a medium made of a resin material such as an OHP seat and a resin film, a wrinkle is unlikely to occur as compared to a paper sheet having a width equal to or more than 320 mm. Therefore, in this case, the upper deburring roll 82A and the lower deburring roll 82B in the deburring device 80 are in the clamping state, thereby reducing scratches on the members disposed downstream.

Furthermore, in the image forming device 1 illustrated in FIG. 1, when an image is formed on each of both sides of a paper sheet, the paper sheet where the image is formed on one of the front and back sides is conveyed along the front-and-back inversion course R2. Subsequently, after the paper sheet turned upside down passes through the deburring device 80, the image is formed on the other side. In this case, in order to prevent occurrence of a disturbance on the image as a result of clamping the paper sheet where the image is already formed on the one of the front and back sides between the upper deburring roll 82A and the lower deburring roll 82B, the upper deburring roll 82A and the lower deburring roll 82B are put in the separated state regardless of the type of paper sheet.

[Deburring Roll]

Here, the upper deburring roll 82A and the lower deburring roll 82B will be described.

Figure 10:
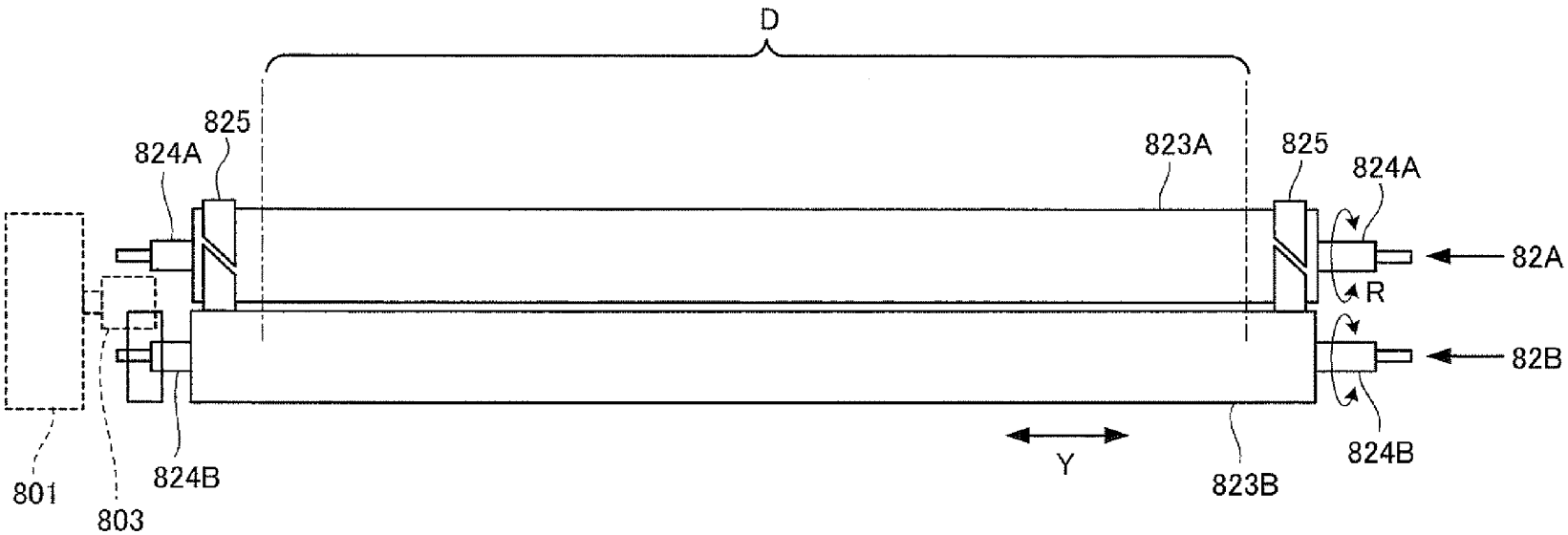
FIG. 10 is a diagram that illustrates the upper deburring roll and the lower deburring roll.

FIG. 10 is a diagram that illustrates the upper deburring roll and the lower deburring roll. FIG. 10 illustrates the upper deburring roll 82A and the lower deburring roll 82B in the postures disposed in the deburring device 80, when viewed in the conveyance direction X. Further, FIG. 10 illustrates the deburring driving motor 801 and a gear 803 that drive the lower deburring roll 82B in a state in which the device main unit 80A (see FIG. 3) is attached to the support section 80B.

The upper deburring roll 82A and the lower deburring roll 82B include roll main sections 823A and 823B each having a circumferential surface to be in contact with the paper sheet, and the rotation shafts 824A and 824B, respectively. The rotation shafts 824A and 824B are fixed at both sides of the roll main section 823A and at both sides of the roll main section 823B, respectively, and supported by the bearings 822A and 822B (see FIG. 7), respectively. The respective circumferential surfaces of the roll main sections 823A and 823B move circularly as the roll main sections 823A and 823B rotate.

Each of the roll main sections 823A and 823B is made of a metal material harder than the paper sheet and is a hollow cylinder having a diameter of 35 mm. Specifically, each of the roll main sections 823A and 823B is made of stainless steel and has a nitrided surface. To be more specific, the surface of each of the roll main sections 823A and 823B is softnitrized. Each of the roll main sections 823A and 823B has a longer length in a direction orthogonal to a rotating direction R of the circumferential surface, namely in the widthwise direction Y in the present exemplary embodiment, than the length in the widthwise direction Y of the paper sheet conveyed between the upper deburring roll 82A and the lower deburring roll 823.

The surface of each of the roll main sections 823A and 823B is made hard by the nitriding. For this reason, the surfaces of the roll main sections 823A and 823B are hard to deform and thus apply a high pressure to the burr when clamping the paper sheet. Therefore, as compared to a case in which the surface is not nitrided, the burr height of the paper sheet is further reduced.

[Belt Member]

Of the upper deburring roll 82A and the lower deburring roll 823, the upper deburring roll 82A is provided with a belt member 825 that is disposed on the circumferential surface of the roll main section 823A and at a position outside an area D that touches the paper sheet. The belt member 825 surrounds the circumferential surface of the roll main section 823A at each of both sides outside the area D that touches, when the paper sheet of the maximum size processable by the image forming device passes between the upper deburring roll 82A and the lower deburring roll 823, this paper sheet of the maximum size. Incidentally, FIG. 10 illustrates the thickness of the belt member 825 in an expanded view for the description of the belt member 825.

The belt member 825 is softer than the roll main section 823A and also thinner than a paper sheet having a minimum thickness (150 μm) among the paper sheets targeted for the deburring by the deburring device 80. To be more specific, the belt member 825 is thinner than the thickness (about 100 μm) of a plain paper sheet widely used as copy paper.

The belt member 825 is a tape having ends and a single layer that surrounds the circumferential surface of the roll main section 823A. Both ends of the belt member 825 are close to each other across a border that is not orthogonal to the rotating direction R. To be more specific, both ends of the belt member 825 extend at an angle of 45 degrees relative to the rotating direction R.

Figure 11:
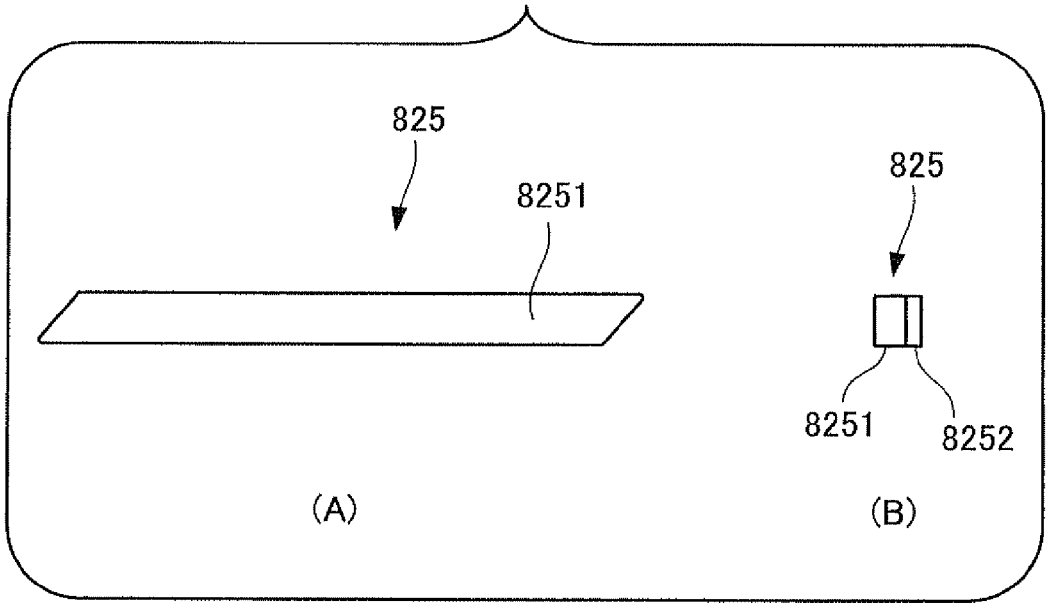
FIG. 11 is a diagram that illustrates the belt member.

FIG. 11 is a diagram that illustrates the belt member. The belt member in a state before being attached to the upper deburring roll 82A is illustrated in FIG. 11. Part (A) of FIG. 11 is a plane view and Part (B) of FIG. 11 is a side view.

The belt member 825 includes a base layer 8251 made of a resin material and an adhesive layer 8252 that adheres this base layer to the circumferential surface. Specifically, the base layer 8251 is a polyimide tape having a thickness of 50 μm, and the adhesive layer 8252 is an adhesive having a thickness of 30 μm. Therefore, the thickness of the entire belt member 825 is 80 μm. Incidentally, as the material of the base layer, polyurethane or polycarbonate that are softer than the roll main section 823A may be employed. However, the base layer made of polyimide provides lower movement sound and higher friction durability than those of other resin materials. In addition, by making the base layer made of polyimide have the thickness of 50 μm, peeling of the end due to hardness and elasticity of the base layer when being wound around the roll is prevented, as compared to a case where the thickness is made equal to or larger than 50 μm.

When no paper sheet is clamped between the roll main section 823A of the upper deburring roll 82A and the roll main section 823B of the lower deburring roll 82B in the clamping state, the belt member 825 is clamped therebetween and thus, the roll main section 823A and the roll main section 823B do not directly contact each other. When the operation of deburring the paper sheet is performed by the deburring device 80, the upper deburring roll 82A and the lower deburring roll 82B clamp the paper sheet in between, so that the distance between the respective circumferential surfaces is extended according to the thickness of the paper sheet. After the tail of the paper sheet passes between the upper deburring roll 82A and the lower deburring roll 82B, the upper deburring roll 82A returns toward the lower deburring roll 82B due to the load applied by the spring member 862 (see FIG. 8). At this moment, a shock occurs due to collision, and if the respective hard circumferential surfaces of the roll main section 823A and the roll main section 823B hit each other, a large shock is produced, causing loud impulsive sound. Moreover, when the shock is transmitted to the image forming sections 10A, 10B, 10C, 10D, 10E and 10F as well as the secondary transfer device 30 of the image forming device, the image is disturbed.

When the belt member 825 is provided, after the tail of the paper sheet passes between the upper deburring roll 82A and the lower deburring roll 82B, the roll main section 823B of the lower deburring roll 82B hits the belt member 825 of the roll main section 823A of the upper deburring roll 82A. A shock occurring here is absorbed by the belt member 825 that is softer than the upper deburring roll 82A and the lower deburring roll 82B.

The belt member 825 is thinner than the paper sheet having the maximum thickness. Therefore, the paper sheet is clamped between the upper deburring roll 82A and the lower deburring roll 82B by the applied load regardless of the belt member 825 when the paper sheet passes therebetween and thus, the burr is corrected without a hitch.

In a state in which there is no passing paper sheet, the upper deburring roll 82A rotates while causing the belt member 825 to touch the roll main section 823B of the lower deburring roll 82B. Here, since both ends of the belt member 825 are close to each other across the border that is not orthogonal to the rotating direction R, the roll main section 823B of the lower deburring roll 82B smoothly rolls across the belt member 825 from one end to the other end of the belt member 825. Therefore, vibrations accompanying the rotation of the lower deburring roll 82B in the state of no recording medium are reduced as compared to a case in which these both ends are orthogonal to the rotating direction R.

[Paper Guide Section]

Subsequently, the paper guide sections 84 and 85 will be described.

Figure 12:
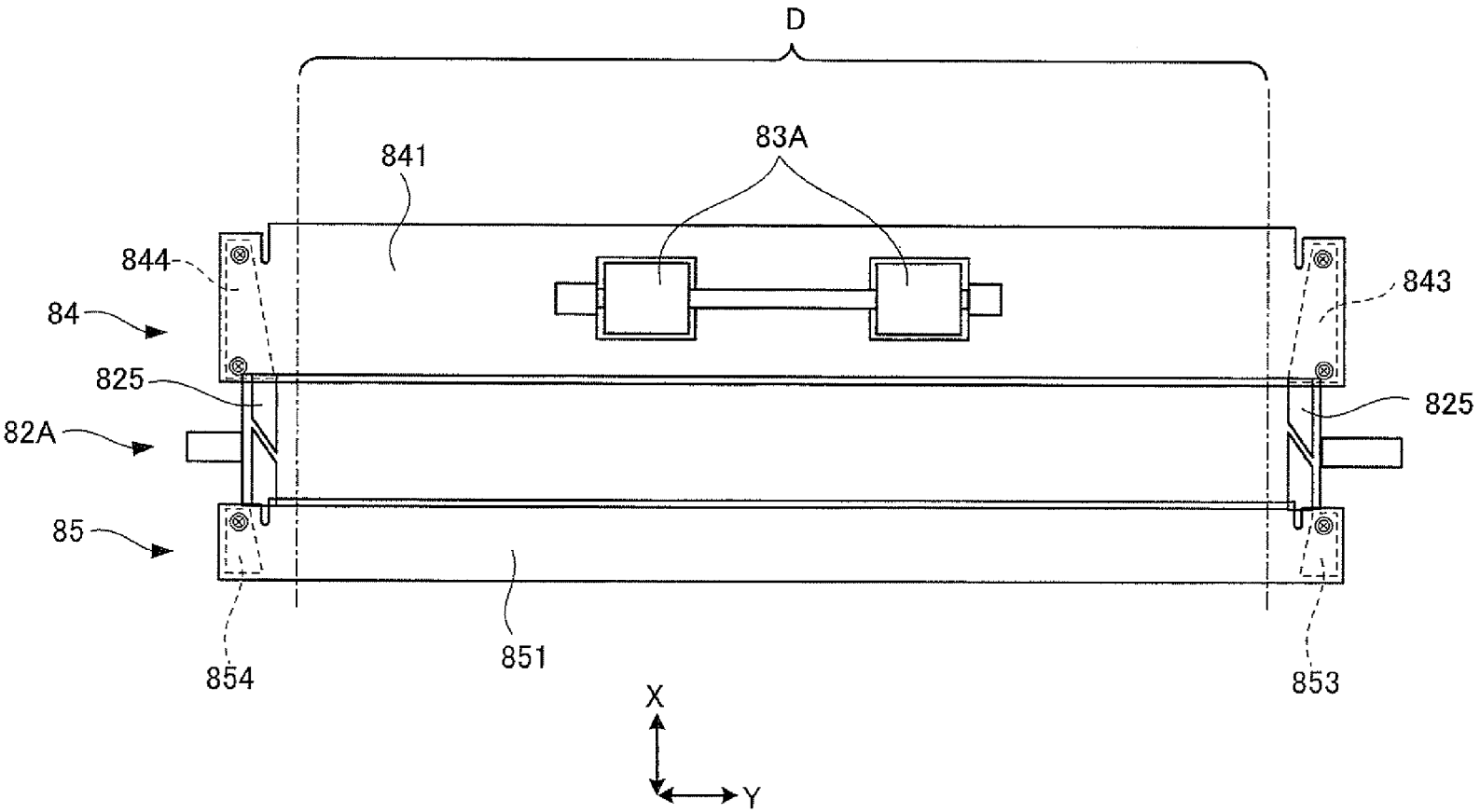
FIG. 12 is a plane view that illustrates the positions of the guide member, the deburring roll and the auxiliary conveyance rolls in the device main unit.

FIG. 12 is a plane view that illustrates the positions of the guide member, the deburring roll and the auxiliary conveyance rolls in the device main unit. FIG. 12 illustrates only the paper guide sections 84 and 85, the upper deburring roll 82A, and the upper auxiliary conveyance rolls 83A.

The paper guide sections 84 and 85 are disposed upstream and downstream from the upper deburring roll 82A, respectively, in the conveyance direction X. The structures of the paper guide section 84 disposed upstream and the paper guide section 85 disposed downstream are the same except the length in the conveyance direction X. The paper guide section 84 includes a pair of flat members 841 and protruding members 843 and 844 interposed between the pair of flat members 841.

Figure 13:
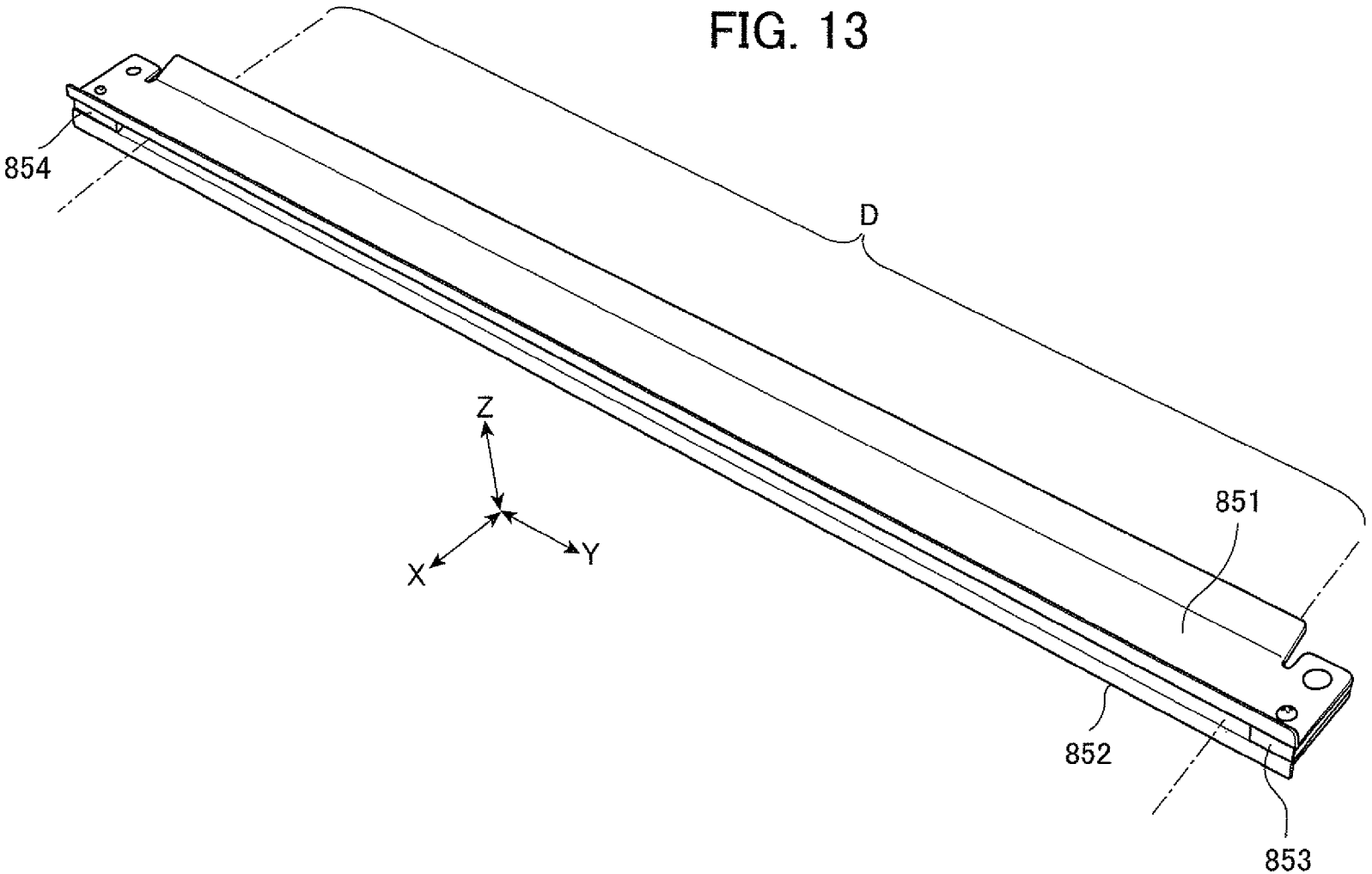
FIG. 13 is a perspective view of the guide member.

FIG. 13 is a perspective view of the guide member. FIG. 13 illustrates, of the two paper guide sections 84 and 85, the paper guide section 85 disposed downstream in the conveyance direction X.

The paper guide section 85 includes a pair of flat members 851 and 852 and protruding members 853 and 854 interposed between the flat members 851 and 852.

Each of the flat members 851 and 852 is in the shape of a plate expanding along the front and back surfaces of the paper sheet passing between the upper deburring roll 82A and the lower deburring roll 82B. A path D where the paper sheet is to pass is provided between the pair of flat members 851 and 852 that sandwich the path D in the vertical direction Z crossing the front and back surfaces of the paper sheet. The protruding members 853 and 854 are flat members that fill the space between the flat members 851 and 852 at both ends in the widthwise direction Y of the flat members 851 and 852, thereby keeping the distance between the pair of flat members 851 and 852 uniform.

Returning to FIG. 12, the description will be continued. Along the path D, the paper sheet is guided by the paper guide section 84 thereby passing between the pair of auxiliary conveyance rolls 83A and the pair of auxiliary conveyance rolls 83B and then, upon passing between the pair of deburring rolls 82A and 82B the paper sheet is guided by the paper guide section 85 and output.

Here, the pair of protruding members 843 and 844 provided in the paper guide section 84 are aligned with the pair of belt members 825 in the conveyance direction X in which the paper sheet passes, and disposed at positions protruding beyond the pair of belt members 825 relative to the path D. In addition, each of the protruding members 843 and 844 has a downstream end and an upstream end in the conveyance direction X, and the downstream end protrudes closer to the path D than the upstream end. For this reason, the position of the paper sheet entering while deviating from the path D is corrected toward the path D.

For example, when removing a paper sheet jamming in the deburring device 80, the operator may pull a protruding part of the paper sheet from the deburring device 80. However, the paper sheet may not be pulled in the conveyance direction X and may rather be pulled toward the operator diagonally relative to the conveyance direction X. In this case, the paper sheet hits the protruding members 843 and 844 protruding beyond the belt members 825, thereby avoiding contact with the belt members 825. Even in a case where the deburring device 80 normally operates, when the paper sheet is supplied to the deburring device 80 while taking a posture tilting relative to the conveyance direction X, the paper sheet hits the protruding members 843 and 844 protruding further than the belt members 825, thereby avoiding contact with the belt members. Therefore, there is avoided such a situation that the belt members 825 softer than the deburring rolls 82A and 82B are scratched or damaged as a result of contact with the paper sheet.

[Support Section]

Next, the support section 80B that supports the device main unit 80A will be described.

Figure 14:
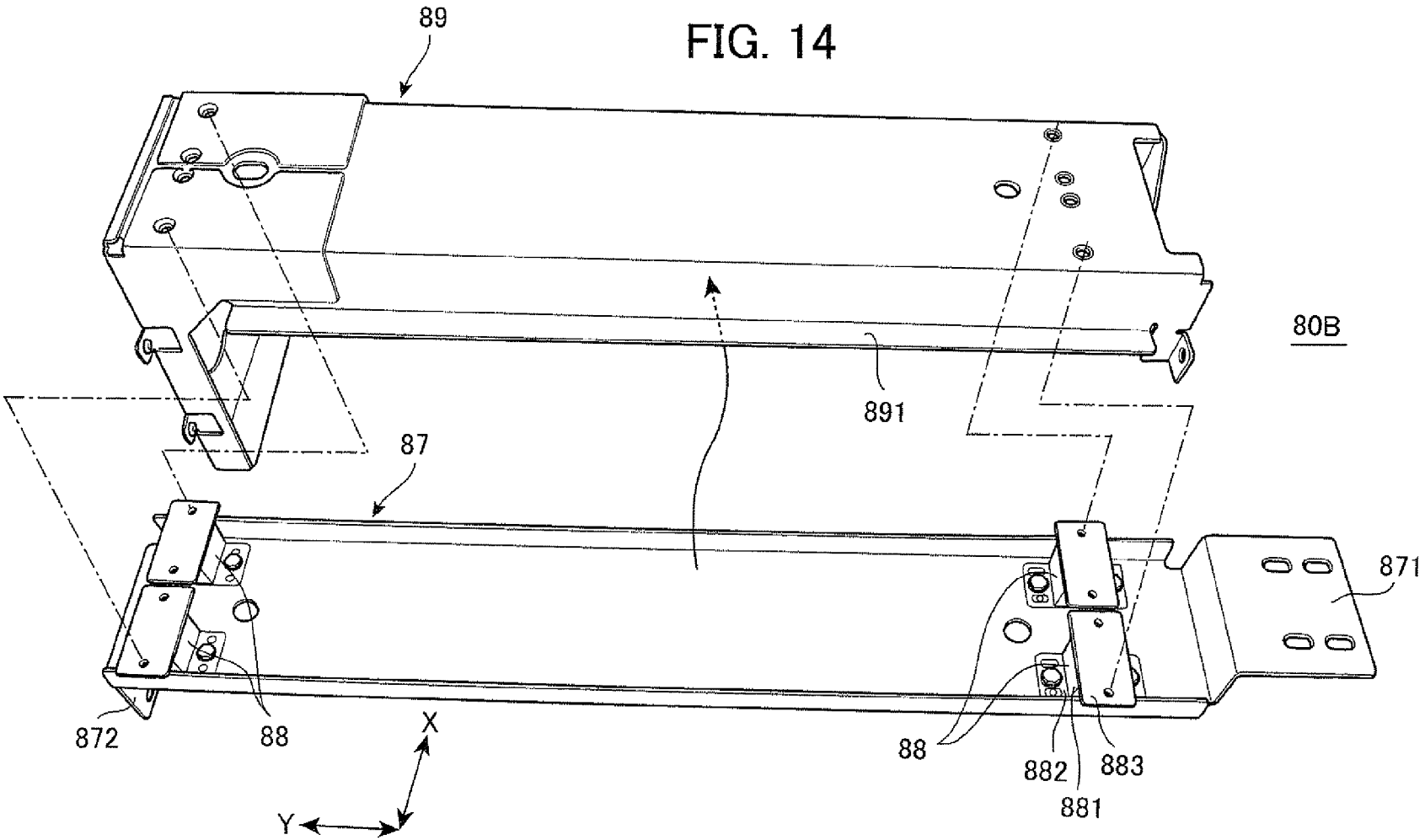
FIG. 14 is an exploded perspective view of the support section illustrated in FIG. 2.

FIG. 14 is an exploded perspective view of the support section illustrated in FIG. 2.

The support section 80B has a fixed section 87, buffer members 88 attached to the fixed section 87, and a rail member 89 attached to the buffer members 88.

The fixed member 87 is fixed to the support frame F of the image forming device 1. To be more specific, when fixing pieces 871 and 872 provided at both ends of the fixed section 87 and extending in the widthwise direction Y are screwed on the support frame F, the fixed section 87 is fixed to the support frame F.

There are four buffer members 88 dispersed and disposed at four points on the fixed section 87. Each of the buffer members 88 has a structure in which a pair of fixing plates 882 and 883 for screwing a buffer material 881 made of urethane resin are respectively adhered to the bottom and the top of the buffer material 881. The buffer material 881 has a height of 15 mm. In FIG. 14, the reference characters 881 through 883 are provided for only one of the four buffer members 88 for easy viewing.

The rail member 89 is a member attached to the buffer member 88, and is disposed and screwed on the fixing plate 883 of the buffer member 88. The rail member 89 includes the rails 891 extending in the widthwise direction Y. Although the rail member 89 is provided with the rails 891 at both sides in the conveyance direction X, FIG. 14 illustrates only one of the rails 891.

Figure 15:
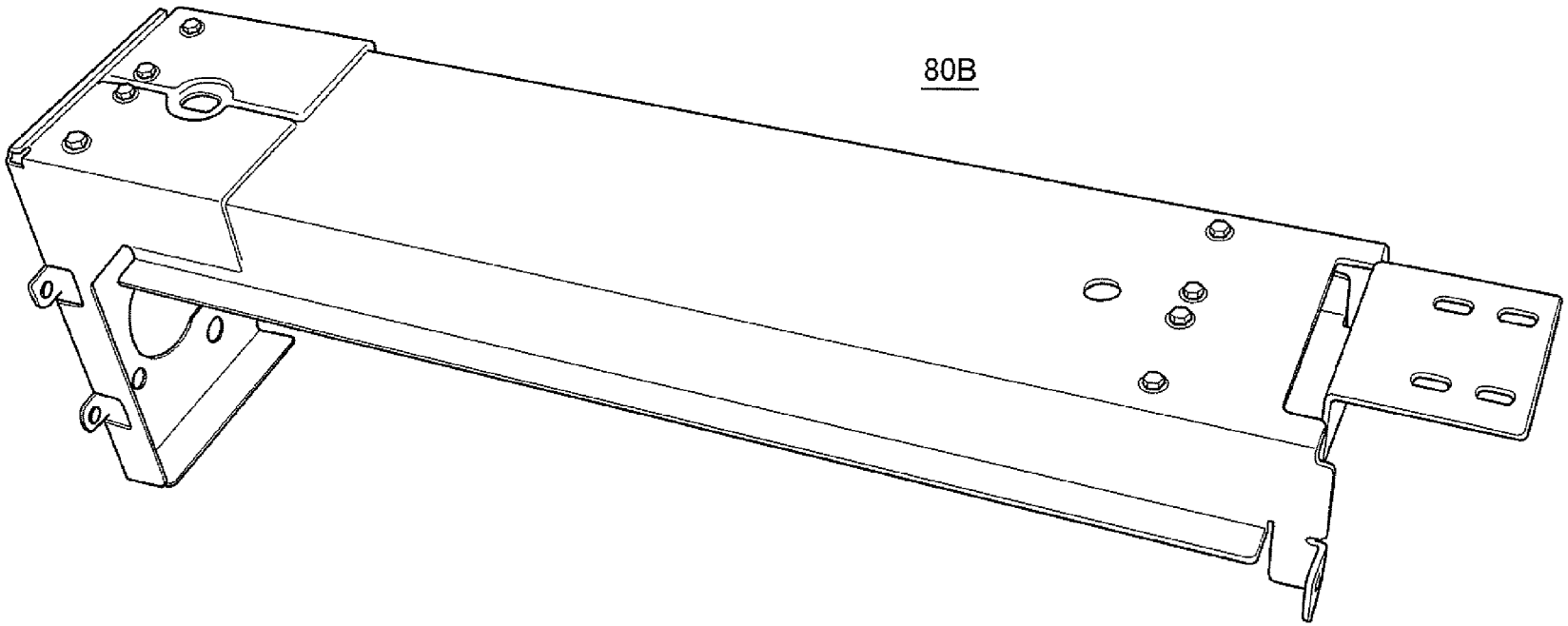
FIG. 15 is a perspective view of the support section in an assembled state. Further.
Figure 16:
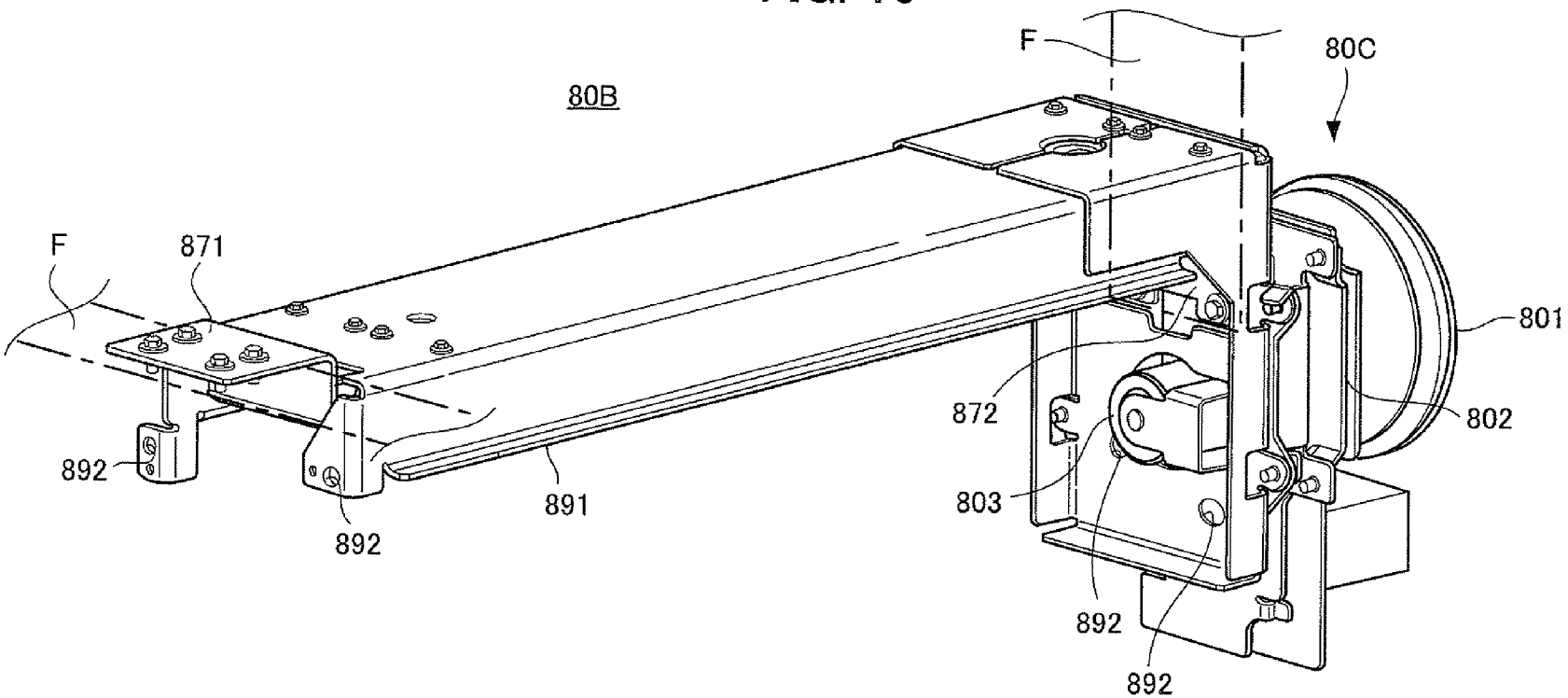
FIG. 16 is a perspective view of the support section in the assembled state when viewed from another angle.

FIG. 15 is a perspective view of the support section in an assembled state. Further, FIG. 16 is a perspective view of the support section in the assembled state when viewed from another angle. FIG. 16 illustrates a state in which the deburring driving motor and the gear are attached to the support section illustrated in FIG. 15.

The support section 80B illustrated in FIG. 15 is assembled by laying and attaching the rail member 89 on and to the buffer members 88 fastened to the fixed section 87 illustrated in FIG. 14. Further, when the motor unit 80C is attached to the rail member 89 of the support section 80B illustrated in FIG. 15, the state illustrated in FIG. 16 is realized. The motor unit 80C illustrated in FIG. 16 includes the deburring driving motor 801, a fixing frame 802 that fixes the deburring driving motor 801 to the rail member 89, and the gear 803 that transmits a driving force of the deburring driving motor 801 to the lower deburring roll 82B. The motor unit 80C is fixed to the rail member 89 of the support section 80B through the fixing frame 802. The rail member 89 of the support section 80B has positioning sections 892 that position the device main unit 80A (see FIG. 4) relative to the rail member 89. Specifically, the positioning sections 892 are holes formed in the rail member 89.

The support section 80B illustrated in FIG. 16 is attached in the image forming device 1 by screwing the fixing pieces 871 and 872 of the fixed section 87 to the support frame F.

To attach the device main unit 80A to the support section 80B, the operator places the edges of the pair of rails 811 (see FIG. 4), which are provided at the upper part of the frame 81 of the device main unit 80A, on the edges of the pair of rails 891 of the support section 803, respectively. Afterwards, as illustrated in FIG. 3, the device main unit 80A is pushed in by the operator and thereby being attached. The gear 803 of the motor unit 80C is connected to the lower deburring roll 82B.

The frame 81 of the device main unit 80A is provided with the projections 812 (FIG. 3) protruding in the widthwise direction Y. When the device main unit 80A is attached, the projections 812 are respectively engaged in the positioning sections 892 provided in the rail member 89 so that the device main unit 80A is positioned relative to the rail member 89.

As already described above, the shock produced when the roll main sections 823A and 823B are in the clamping state is absorbed and thus reduced by the belt member 825 of the roll main section 823A. However, when a residual shock as not being absorbed and/or vibration due to the movements of the device main unit 80A other than this shock are transmitted to the image forming sections 10A, 10B, 10C, 10D, 10E and 10F and the secondary transfer device 30, the image is disturbed. The support section 803 alleviates the transmission of the shock and vibration by using the buffering mechanism incorporated therein. Incidentally, in the following description, the vibration will be included in the shock, unless otherwise specified.

Figure 17:
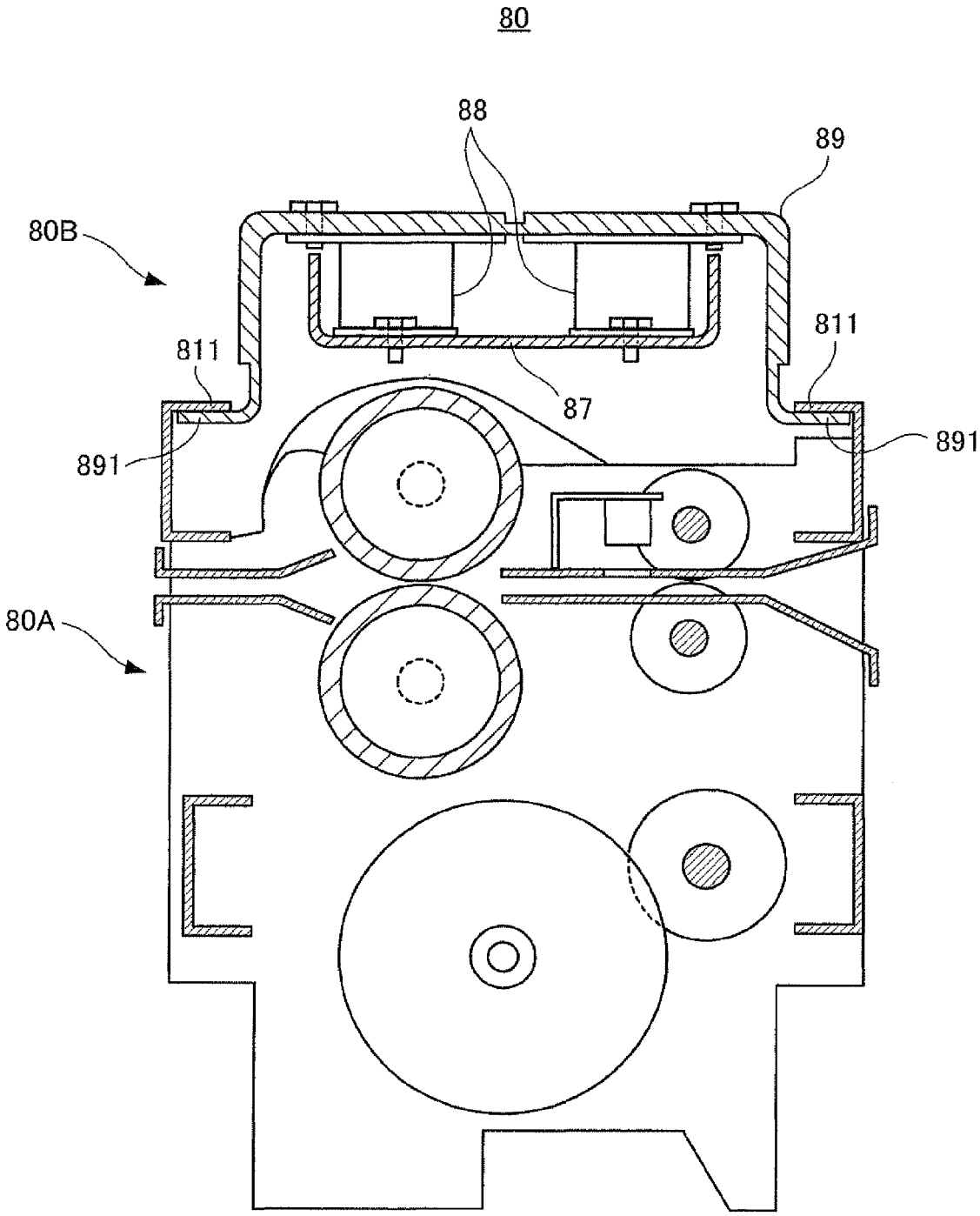
FIG. 17 is a cross-sectional view for describing a structure of supporting the device main unit by using the support section.

FIG. 17 is a cross-sectional view for describing a structure of supporting the device main unit by using the support section.

As illustrated in FIG. 17, in the state that the device main unit 80A is attached to the support section 80B, the buffer members 88 are disposed on the fixed section 87 fixed to the support frame F (see FIG. 16) of the image forming device 1, and the rail member 89 is disposed on the buffer members 88. Further, the rails 811 of the device main unit 80A are disposed on the rails 891 of the rail member 89. If there is adopted such a structure that the rail member is hung under the fixed member through the buffer members, there is a possibility that the buffer members may break due to a tension by the weight of the device main unit, and an adhered part may come off. In contrast, the structure of supporting the device main unit 80A illustrated in FIG. 17 is made stronger, as compared to the structure in which the rail member is hung under the fixed member through the buffer members. Furthermore, as already described above, the device main unit 80A is positioned relative to the rail member 89 by the projections 812 (see FIG. 3) and the positioning sections 892 (FIG. 16), and the motor unit 80C also is fixed to the support section 80B.

The transmission of the shock occurring in the device main unit 80A from the rail member 89 to the fixed section 87 is reduced by the buffer members 88. Therefore, the shock transmitted from the device main unit 80A to the image forming sections 10A, 10B, 10C, 10D, 10E and 10F and the secondary transfer device 30 is reduced. As a result, disturbance of the image formed on the paper sheet due to the shock is reduced. Incidentally, the buffer material 881 made of urethane resin has been described, but rubber or a spring other than the urethane resin may be employed to make the buffer material.

EXAMPLE

An image forming device of an example based on the exemplary embodiment is made, and characteristics are measured.

[Measurement of Burr Height]

A paper sheet is passed in the deburring device, and the burr height H (FIG. 6) of a burr of the paper sheet before passing and that after passing are measured.

Figure 18:
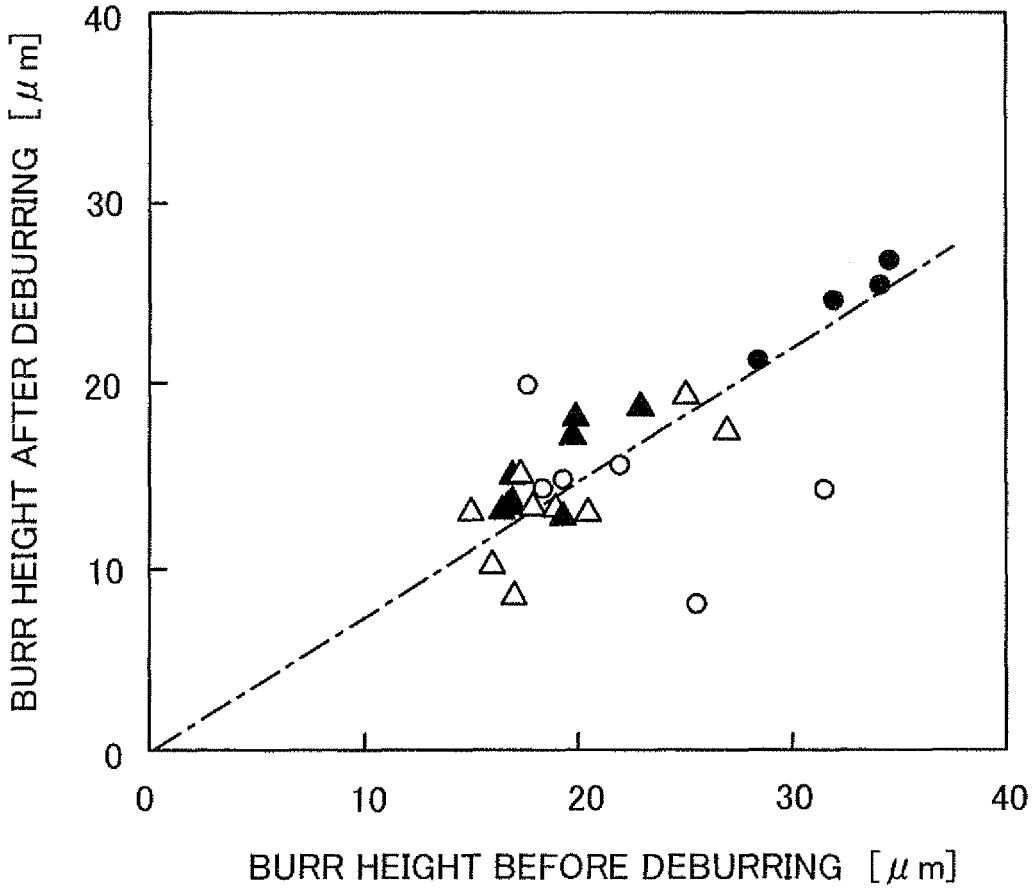
FIG. 18 is a graph that illustrates the burr heights of the paper sheet before and after the processing by the deburring device.

FIG. 18 is a graph that illustrates the burr heights of the paper sheet before and after the processing by the deburring device.

As illustrated in the graph, the burr height after the deburring processing is reduced as compared to the burr height before the deburring processing.

[Evaluation of Scratch on Member in Later Stage]

Subsequently, the amount of scratches produced on the fixing belt 410 of the fixing device 40 (see FIG. 1) disposed downstream from the deburring device is checked for a case in which the deburring processing is performed by the deburring device and a case in which the deburring processing is not performed. The amount of scratches produced on the belt is evaluated by viewing from 0 (no scratch is found) to 5 grades in steps of 0.5.

Figure 19:
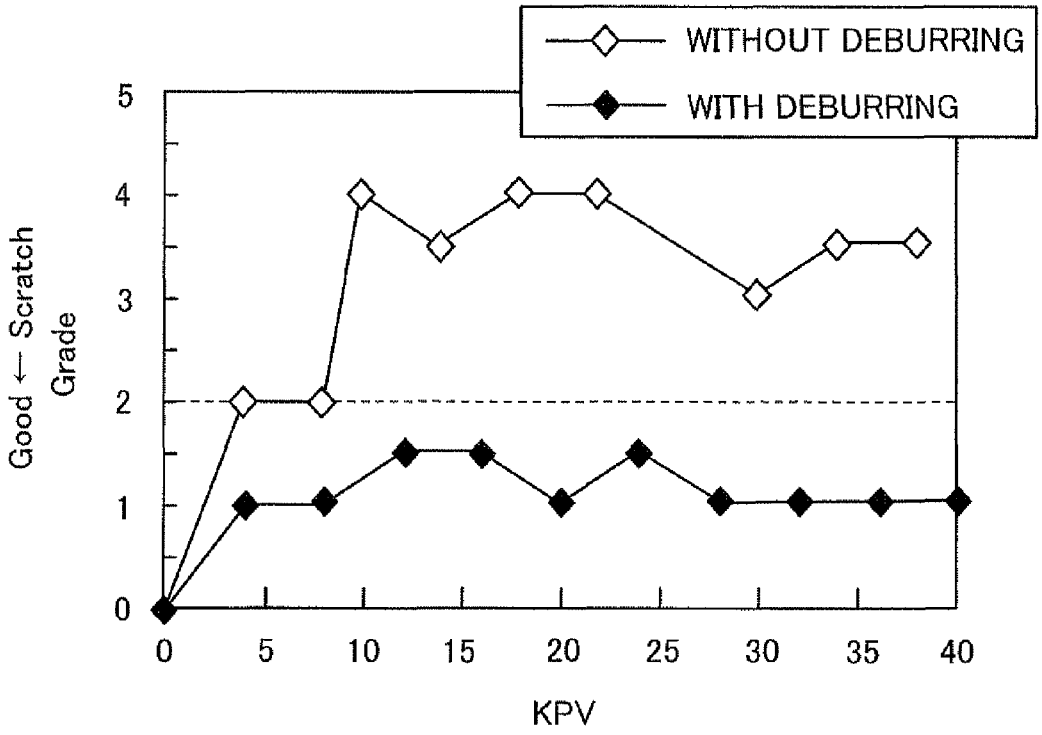
FIG. 19 is a graph that illustrates the amount of scratches produced on the belt of the fixing device in the image forming device.

FIG. 19 is a graph that illustrates the amount of scratches produced on the belt of the fixing device in the image forming device. A horizontal axis of the graph indicates the number of paper sheets processed by the image forming device, and the unit of the numbers is 1,000 sheets (kPV).

As illustrated in FIG. 19, when the deburring processing is not carried out (without deburring), the grade expressing the amount of scratches produced on the belt of the fixing device at a stage where 5,000 sheets are processed is increased to 2, and the grade at a stage where 10,000 sheets are processed is increased to 4. On the other hand, when the deburring processing is carried out (with deburring), the grade does not reach 2 even at a stage where 40,000 sheets are processed.

[Measurement of Noise in Bach Condition of Belt Member]

Next, influence of the belt member 825 provided in the upper deburring roll 82A on operating sound and durability of the belt member are examined.

For an image forming device of an example 1 based on the exemplary embodiment, steady sound at the time of the deburring operation is measured. Incidentally, the belt member in the example 1 includes a base layer made of polyimide and having a thickness of 50 μm and an adhesive layer having a thickness of 30 μm. Further, an example 2 is made by employing a base layer having the same thickness as that in the example 1 and made of another material, namely polyurethane. Furthermore, an example 3 is made by employing a base layer made of polyimide and having a thickness of 70 μm. Still further, an example 4 is made by employing a base layer having the same thickness as that in the example 3 and made of polycarbonate. In each of the examples 3 and 4, in order to make the height of the belt member less than the thickness of the target recording medium, the adhesive layer is made to have a thickness of 10 μm. Still furthermore, a comparative example having no belt member (tape) is prepared. These examples 1 through 4 and the comparative example are operated, and the steady sound is measured.

Figure 20:
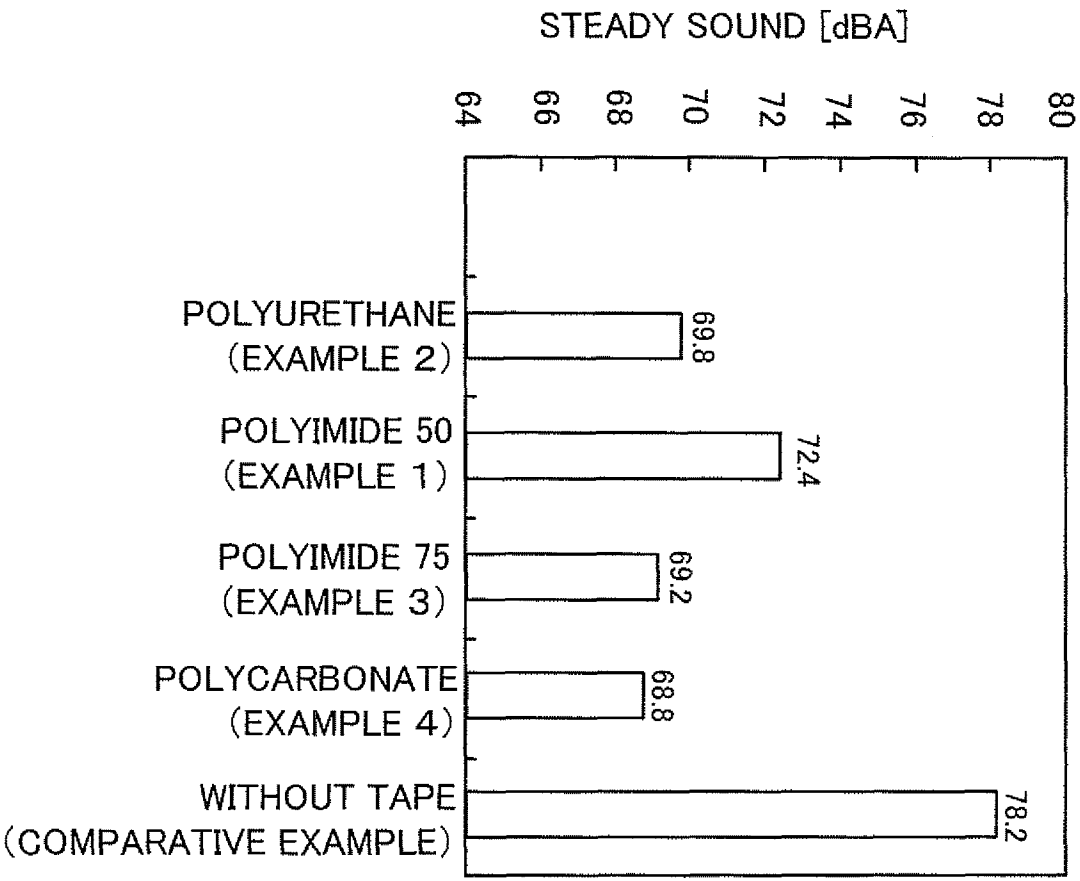
FIG. 20 is a graph that illustrates the operating sound in each condition of the belt member.

FIG. 20 is a graph that illustrates the operating sound in each condition of the belt member.

As illustrated in the graph, as compared to the comparative example having no belt member, the level of the steady sound is reduced in each of the examples 1 through 4 each having the belt member.

[Durability Test of Belt Member]

Here, durability of the belt member in each of the examples 1 through 4 is examined. As the durability, adhesive strength and abrasion resistance of the belt member are measured.

The adhesive strength in each of the examples 1 through 4 is measured as follows. After the belt member is adhered to the upper deburring roll, the belt member is left alone for 24 hours and then the adhesive strength at the time when the belt member is peeled by a 90 degrees peeling method is measured. The results obtained by measuring the adhesive strength are as follows.

Example 1 (polyimide 50 μm): 300 gw
Example 2 (polyurethane 50 μm): 330 gw
Example 3 (polyimide 70 μm): 100 gw
Example 4 (polycarbonate 70 μm): 150 gw Further, as for the example 3, after the belt member is adhered to the upper deburring roll and then the belt member is left alone for 24 hours, pealing at an end of the roll is found.

In the measurement of the abrasion resistance, a load test is run on the friction. Specifically, in the deburring device 80 in each of the examples 1 through 4, the upper deburring roll provided with the belt member is prevented from rotating and given a load of 55 kgw. In this state, when the lower deburring roll is driven to rotate, the lower deburring roll rotates while rubbing against a single spot of the belt member.

As a result, the base material of the belt member in the example 2 (polyurethane 50 μm) is damaged after 60 minutes and the base material of the belt member in the example 4 (polycarbonate 70 μm) is damaged after 50 minutes, each following the start of the rotation of the lower deburring roll. In the example 1 (polyimide 50 μm) and the example 3 (polyimide 70 μm), no damage is found even after a lapse of 12 hours following the start of the rotation of the lower deburring roll.

[Transmission Property of Shock]

Next, there is measured transmission property of a shock transmitted from the device main unit 80A to the support frame F of the image forming device 1, under a condition with the buffer members 88 and a condition without the buffer members 88.

In the image forming device of the example 1, a sensor that detects vibration is attached to each of the frame 81 (see FIG. 4) of the deburring device and the support frame F (see FIG. 16) of the image forming device 1, and then a shock is applied to the frame 81 of the deburring device. Subsequently, a ratio between the amplitude of the vibration due to the shock detected by one of the sensors and that of the other sensor is measured as a gain of a transmission function. Also, the ratio between the vibrations is measured in a comparative example in which the rail member 89 is directly fixed to the fixed section 87 without using the buffer members 88.

Figure 21:
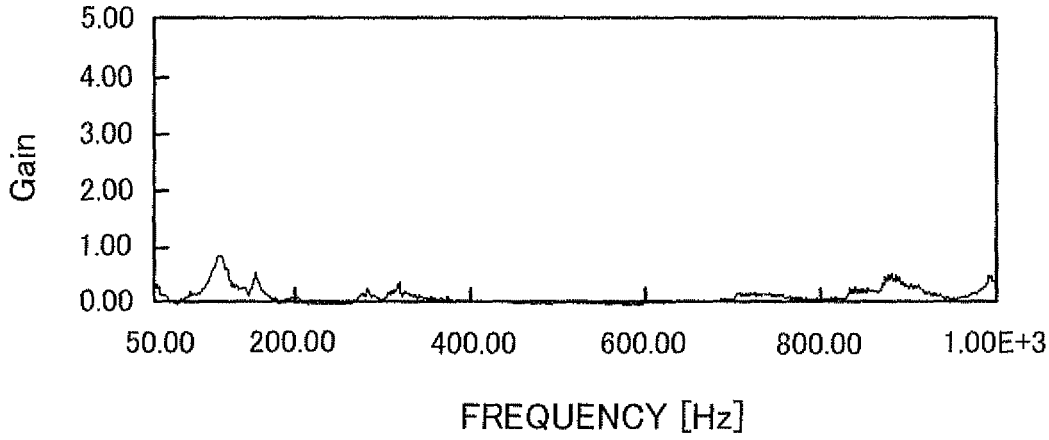
FIG. 21 is a graph that illustrates the ratio between the vibration in the frame of the deburring device and the vibration in the support frame of the image forming device, in the image forming device of the example 1.
Figure 22:
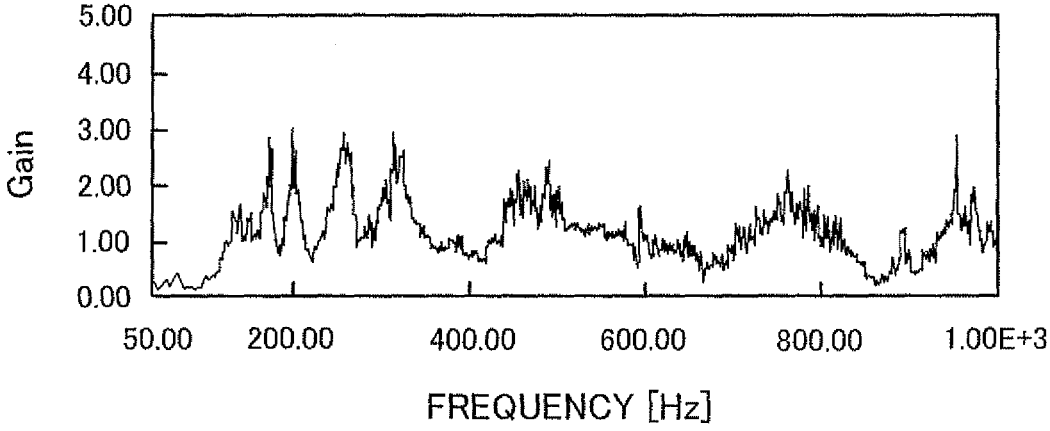
FIG. 22 is a graph that illustrates the ratio between the vibration in the frame of the device main unit and the vibration in the support frame of the image forming device, in the comparative example.

FIG. 21 is a graph that illustrates the ratio between the vibration in the frame of the deburring device and the vibration in the support frame of the image forming device, in the image forming device of the example 1. Further, FIG. 22 is a graph that illustrates the ratio between the vibration in the frame of the device main unit and the vibration in the support frame of the image forming device, in the comparative example. A horizontal axis of the graph in each of FIG. 21 and FIG. 22 indicates the frequency (component) of the vibration, and a vertical axis indicates the ratio (gain) of the vibration in the support frame of the image forming device to the vibration in the frame of the device main unit.

The ratio (gain) of the vibration in the image forming device of the example 1 illustrated in the graph of FIG. 21 is reduced to be less than the ratio of the vibration in the comparative example illustrated in the graph of FIG. 22, in any of the frequencies in the graph. Further, the ratio of the vibration in the example 1 is smaller than 1 in any of the frequencies in the graph. It is found that the transmission of the shock from the main unit of the deburring device to the support frame of the image forming device is alleviated by providing the buffer members 88.

Incidentally, in the exemplary embodiment, the tandem type of color printer is described as an example of the image forming device, but the image forming device is not limited to this example and may be, for example, a printer dedicated to monochrome and having no intermediate transfer belt.

Further, in the exemplary embodiment, the printer is described as an example of the image forming device, but the image forming device is not limited to this example and may be, for example, a copier or a facsimile.

Furthermore, in the exemplary embodiment, the combination of the charging device, the exposure device and the developing device is described as an example of the image forming section, but the image forming section is not limited to this example and may be, for example, an element that causes a toner to directly adhere to a position corresponding to an image on an image retainer by aiming that position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium clamping device comprising:

a first circularly moving body that has a circumferential surface moving circularly and harder than a recording medium with a surface where an image is formed, and that has a longer length in a direction orthogonal to a circularly moving direction of the circumferential surface than a length in a first direction of the surface of the recording medium;

a second circularly moving body that has a circumferential surface moving circularly and harder than the recording medium, and that has a longer length in a direction orthogonal to a circularly moving direction of the circumferential surface of the second circularly moving body than the length in the first direction of the surface of the recording medium, where the recording medium passes between and contacts the circumferential surface of the first circularly moving body and the circumferential surface of the second circularly moving body in a second direction crossing the first direction;

a load applying section that clamps, by applying a load to at least one of the first circularly moving body and the second circularly moving body, the recording medium by the load by using the first circularly moving body and the second circularly moving body;

a belt member that surrounds the circumferential surface of at least one of the first circularly moving body and the second circularly moving body, at a place outside an area touching the recording medium when the recording medium passes, and that is softer than the circumferential surface and is thinner than the recording medium; and a belt member protecting member that is aligned with the belt member in a direction of passing for the recording medium, that includes a portion closer to a path of passing for the recording medium than the belt member, and that protects the belt member from contacting the recording medium.

2. The medium clamping device according to claim 1, further comprising a pair of plate members that respectively expand along a front surface and a back surface of the recording medium passing between the first circularly moving body and the second circularly moving body, that sandwich, in a direction crossing the front and back surfaces of the recording medium, the path where the recording medium passes, and that have in between a space filled with the belt member protecting member.

3. The medium clamping device according to claim 2, wherein the belt member protecting member extends along the path where the recording medium passes and, has an upstream end and a downstream end in the direction of passing, where the downstream end is closer to the path than the upstream end.

4. The medium clamping device according to claim 1, wherein the belt member protecting member extends along the path where the recording medium passes and, has an upstream end and a downstream end in the direction of passing, where the downstream end is closer to the path than the upstream end.

5. The medium clamping device according to claim 1, wherein the belt member has a thickness of 100 μm or less.

6. The medium clamping device according to claim 1, wherein the belt member includes multiple layers.

7. The medium clamping device according to claim 1, wherein the belt member includes a base layer and an adhesive layer.

8. The medium clamping device according to claim 1, wherein the belt member includes a resin material.

9. The medium clamping device according to claim 1, wherein the belt member includes at least a polyimide tape, polyurethane, or polycarbonate.

10. The medium clamping device according to claim 1, wherein the belt member includes a base layer having a thickness of 50 μm or less.

11. The medium clamping device according to claim 1, wherein the belt member includes an adhesive layer having a thickness of 30 μm or less.

12. An image forming device comprising:

a first circularly moving body that has a circumferential surface moving circularly and harder than a recording medium with a surface where an image is formed, and that has a longer length in a direction orthogonal to a circularly moving direction of the circumferential surface than a length in a first direction of the surface of the recording medium;

a second circularly moving body that has a circumferential surface moving circularly and harder than the recording medium, and that has a longer length in a direction orthogonal to a circularly moving direction of the circumferential surface of the second circularly moving body than the length in the first direction of the surface of the recording medium, where the recording medium passes between and contacts the circumferential surface of the first circularly moving body and the circumferential surface of the second circularly moving body in a second direction crossing the first direction;

a load applying section that clamps, by applying a load to at least one of the first circularly moving body and the second circularly moving body, the recording medium by the load by using the first circularly moving body and the second circularly moving body;

a belt member that surrounds the circumferential surface of at least one of the first circularly moving body and the second circularly moving body, at a place outside an area touching the recording medium when the recording medium passes, and that is softer than the circumferential surface and is thinner than the recording medium; and a belt member protecting member that is aligned with the belt member in a direction of passing for the recording medium, that includes a portion closer to a path of passing for the recording medium than the belt member, and that protects the belt member from contacting the recording medium; and an image forming section that forms the image on the surface of the recording medium which passes between the circumferential surface of the first circularly moving body and the circumferential surface of the second circularly moving body.

13. The image forming device according to claim 12, wherein the belt member has a thickness of 100 μm or less.

14. The image forming device according to claim 12, wherein the belt member includes multiple layers.

15. The image forming device according to claim 12, wherein the belt member includes a base layer and an adhesive layer.

16. The image forming device according to claim 12, wherein the belt member includes a resin material.

17. The image forming device according to claim 12, wherein the belt member includes at least a polyimide tape, polyurethane, or polycarbonate.

18. The image forming device according to claim 12, wherein the belt member includes a base layer having a thickness of 50 μm or less.

19. The image forming device according to claim 12, wherein the belt member includes an adhesive layer having a thickness of 30 μm or less.

* * * * *